US007028370B2

(12) United States Patent
Hoshide et al.

(10) Patent No.: US 7,028,370 B2
(45) Date of Patent: Apr. 18, 2006

(54) RETRACTING APPARATUS, DRAWER APPARATUS AND SLIDING DOOR APPARATUS

(75) Inventors: Kaoru Hoshide, Tokyo (JP); Soichi Sasaki, Tokyo (JP)

(73) Assignee: THK Co., Ltd., Tokyo (JP)

( * ) Notice: Subject to any disclaimer, the term of this patent is extended or adjusted under 35 U.S.C. 154(b) by 131 days.

(21) Appl. No.: 10/809,938

(22) Filed: Mar. 26, 2004

(65) Prior Publication Data

US 2004/0237252 A1 Dec. 2, 2004

(30) Foreign Application Priority Data

Mar. 31, 2003 (JP) ..... 2003-097179
Jul. 14, 2003 (JP) ..... 2003-273965
Feb. 27, 2004 (JP) ..... 2004-054718

(51) Int. Cl.
*E05D 15/00* (2006.01)

(52) U.S. Cl. ..... 16/96 R; 16/90; 312/333

(58) Field of Classification Search ..... 16/72, 16/80, 96 R, 90, 91, 93 R, 219, 198, 199, 16/194, 71; 312/330.1, 333, 319.1, 334.1; 211/26; 292/60
See application file for complete search history.

(56) References Cited

U.S. PATENT DOCUMENTS 801,400 A * 10/1905 Rosenberg ..... 292/60
5,020,868 A * 6/1991 Brunnert ..... 312/319.1
5,207,781 A * 5/1993 Rock ..... 312/319.1
5,302,016 A * 4/1994 Lautenschlager et al. ... 312/333
5,364,179 A * 11/1994 Brustle et al. ..... 312/333
5,580,138 A * 12/1996 Grabher ..... 312/319.1
6,736,471 B1 * 5/2004 Lin ..... 312/333
2001/0008037 A1 * 7/2001 Brustle ..... 16/71
2003/0106864 A1 * 6/2003 Kaminski ..... 211/26
2003/0189395 A1 * 10/2003 Doornbos et al. ..... 312/334.1
2004/0000850 A1 * 1/2004 Lam Harn et al. ..... 312/333

FOREIGN PATENT DOCUMENTS

DE 3149972 A1 * 7/1983
JP 2-286102 11/1990
JP 02286102 A * 11/1990

* cited by examiner

*Primary Examiner*—Chuck Y. Mah
*Assistant Examiner*—Mark T. Vogelbacker
(74) *Attorney, Agent, or Firm*—Westerman, Hattori, Daniels & Adrian, LLP.

(57) ABSTRACT

The invention provides a retracting apparatus of a sliding rail in which a self locking state is not cancelled without intention, a structure and an adjustment are simple, and a cost is inexpensive. In the retracting apparatus of the sliding rail, a guiding member (13) is provided with two parallel arranged guiding grooves (13*a*, 13*b*) which are linear in a predetermined range of a drawing and retracting direction, and are bent at a predetermined amount toward an approximately vertical lower side in an end portion in a drawing direction, an engagement member is provided with sliding pins (12*d*, 12*e*), and the sliding pins (12*d*, 12*e*) slide along the guiding grooves (13*a*, 13*b*) in accordance with movement in the drawing direction, and moves downward at a predetermined amount in an end portion in the drawing direction, whereby an engagement between the engagement member (12) and a driving member (11) is cancelled, the engagement member (12) is locked, the driving member (11) and the engagement member (12) are engaged with each other at an automatic retract position on the basis of the movement of the moving rail in the retracting direction, and the lock is cancelled.

6 Claims, 17 Drawing Sheets

(A)

(B)

(A)

(B)

(A)

(B)

(C)

(A)

(B)

RETRACTING APPARATUS, DRAWER APPARATUS AND SLIDING DOOR APPARATUS

BACKGROUND OF THE INVENTION

The present invention relates to a retracting apparatus which is provided with a fixed body and a moving body supported to the fixed body so as to freely move in a predetermined range, and when the moving body moves from one moving end position or another moving end position in a direction of the another moving end position or in a direction of the one moving end position, and reaches an automatic retract position a predetermined distance apart from the another moving end position or the one moving end position, is automatically retracted to the another moving end position or the one moving end position, such as a drawer apparatus, a sliding door apparatus or the like.

Conventionally, as this kind of retracting apparatus, there is a closing apparatus for a drawer which is disclosed in Japanese Unexamined Patent Publication No. 5-23763.

The closing apparatus for the drawer is a closing apparatus for a drawer which is constituted by supporting rails firmly attached to the drawer, a plurality of load transmission rails mounted to the supporting rails or between the supporting rails and the like. The closing apparatus for the drawer is constituted by an inclined portion 103 which is mounted to a furniture main body and is operated by a spring 101 and a driving pin 102 mounted to the drawer, as shown in FIGS. 1A and 1B, and is structured such that the inclined portion 103 is guided by a guide track 106 formed by a groove or the like and constituted by a forward arch portion 104 and a straight portion 105 adjacent to the arch portion 104, and the inclined portion 103 is held by the arch portion 104 in accordance with a self locking method.

In this case, reference numerals 107 and 017 denote bolts which are fixed to the inclined portion 103 and slide along the arch portion 104.

Since the drawer closing apparatus mentioned above is structured such that the inclined portion 103 is self locked by the forward arch portion 104 of the guide track 106, the self locking is easily cancelled, so that there is a risk that the inclined portion 103 is retracted by the spring 101 without intention. Accordingly, it is necessary that a recovering mechanism is provided for recovering the retraction. As a result, there is a problem that a structure of the apparatus is complex and a cost increase is generated.

Further, in order to effectively self lock, a mounting position of an end portion of the spring 101 to the inclined portion 103 is important (in accordance with the mounting position, the self locking may not be achieved, or the self locking may be easily cancelled). Accordingly, there is a problem that an adjustment is complex.

SUMMARY OF THE INVENTION

Taking the matter mentioned above into consideration, an object of the present invention is to provide a retracting apparatus, a drawer apparatus and a sliding door apparatus in which a self locking state is not cancelled without intention, a structure and an adjustment are simple, and a cost is inexpensive.

Further, an object of the present invention is to provide a retracting apparatus which can easily recover an automatic retracting function by moving a moving body in a direction of one moving end position or in a direction of another moving end position even in the case that the automatic retracting function is lost, and a drawer apparatus and a sliding door apparatus which use the retracting apparatus.

In order to achieve the object mentioned above, in accordance with a first aspect of the present invention, there is provided a retracting apparatus which is provided with a fixed body and a moving body supported to the fixed body so as to freely move from one moving end position to another moving end position, and is automatically retracted to the one moving end position or the another moving end position, in the case that the moving body moves toward the one moving end position or the another moving end position and reaches an automatic retract position a predetermined distance apart from the one moving end position or the another moving end position, comprises:

a driving member mounted to a side of the moving body or a side of the fixed body;

an engagement member engaged with the driving member;

a guiding member guiding the engagement member; and an energizing member energizing the engagement member in a retracting direction, wherein the guiding member is provided with a guiding groove which guides the engagement member in a predetermined range of a drawing and retracting direction during a period that the moving body moves between a retract end position and the automatic retract position, the guiding groove is constituted by two parallel arranged guiding grooves which are linear in the predetermined range of the drawing and retracting direction, and are bent at a predetermined amount toward an approximately vertical lower side in an end portion in the drawing direction, the engagement member is provided with two sliding pins respectively sliding along two guiding grooves, and two sliding pins of the engagement member slide along two guiding grooves in accordance with movement of the moving body in the drawing direction, and move downward at a predetermined amount in the end portion of the guiding grooves in the drawing direction, whereby an engagement between the engagement member and the driving member is cancelled, the engagement member is locked, the driving member and the engagement member are engaged with each other at the automatic retract position on the basis of the movement of the moving body in the retracting direction, and the lock of the engagement member is cancelled.

The retracting apparatus is provided with the driving member mounted to the side of the moving body or the side of the fixed body, the engagement member engaged with the driving member, the guiding member guiding the engagement member, and the energizing member energizing the engagement member in the retracting direction, and is structured such that the engagement member moves downward in the approximately vertical direction at the predetermined amount in the retracting direction of the guide groove on the basis of the movement of the moving rail in the retracting direction, whereby the engagement between the engagement member and the driving member is cancelled, and the engagement member is locked. Accordingly, the engagement member is not retracted without intention. Therefore, it is not necessary that the recovering mechanism is provided, and the structure of an entire apparatus is simple.

Further, since the engagement member slides along two parallel arranged guiding grooves of the guiding member via two sliding pins, the sliding motion of the engagement member is stable, and the operation of the retracting apparatus is stable.

In this case, mounting to the side of the moving body or the side of the fixed body means to mount to the moving body or the fixed body itself, and to indirectly mount to the moving body or the fixed body.

In accordance with a second aspect of the present invention, there is provided a retracting apparatus which is provided with a fixed body and a moving body supported to the fixed body so as to freely move from one moving end position to another moving end position, and is automatically retracted to the one moving end position or the another moving end position, in the case that the moving body moves toward the one moving end position or the another moving end position and reaches an automatic retract position a predetermined distance apart from the one moving end position or the another moving end position, comprising:

a driving member mounted to a side of the moving body or a side of the fixed body;

an engagement member engaged with the driving member;

a sliding member with which the engagement member is engaged;

a guiding member guiding the sliding member; and an energizing member energizing the sliding member in a retracting direction, wherein the guiding member is provided with a guiding groove which guides the sliding member in a predetermined range of a drawing and retracting direction during a period that the moving body moves between a retract end position and the automatic retract position, the guiding groove is constituted by a guiding groove which are linear in the predetermined range of the drawing and retracting direction, and are bent at a predetermined amount toward an approximately vertical lower side in an end portion in the drawing direction, the engagement member and the sliding member are provided with sliding pins respectively sliding along the guiding grooves, a sliding groove along which the engagement member slides in an approximately vertical direction is formed in the sliding member, the sliding pins of the sliding member and the engagement member slide along the guiding grooves in accordance with movement of the moving body in the drawing direction, the sliding pin of the engagement member moves downward at a predetermined amount in the end portion of the guiding groove in the drawing direction, and the engagement member moves downward at a predetermined amount with respect to the sliding member via the sliding groove, whereby an engagement between the engagement member and the driving member is cancelled, the engagement member is locked, the driving member and the engagement member are engaged with each other at the automatic retract position on the basis of the movement of the moving body in the retracting direction, and the lock of the engagement member is cancelled.

The retracting apparatus is provided with the driving member mounted to the side of the moving body or the side of the fixed body, the engagement member engaged with the driving member, the sliding member with which the engagement member is engaged, the guiding member guiding the sliding member, and the energizing member energizing the sliding member in the retracting direction, and is structured such that the sliding member and the engagement member slide along the guiding groove of the guiding member in accordance with the movement of the moving body in the drawing direction, the engagement member moves downward in the approximately vertical direction at the predetermined amount with respect to the sliding member at the end portion in the drawing, whereby the engagement between the engagement member and the driving member is cancelled, and the engagement member is locked. Accordingly, the engagement member is not retracted without intention.

Further, since the sliding member energized in the retracting direction by the energizing member slides along the guiding groove of the guiding member only in the drawing and retracting direction, the energizing member is not deflected in a vertical direction or a horizontal direction, so that it is possible to structure the apparatus compact.

Further, it is preferable that the apparatus is assembled in a narrow guiding apparatus such as a slide rail, accordingly.

In this case, mounting to the side of the moving body or the side of the fixed body means to mount to the moving body or the fixed body itself, and to indirectly mount to the moving body or the fixed body, in the same manner as mentioned above.

In accordance with a third aspect of the present invention, there is provided a drawer apparatus provided with a drawer portion which is freely drawn and retracted with respect to the apparatus main body, wherein the drawer apparatus is provided with the retracting apparatus as stated in the first or second aspect of the present invention, the fixed body of the retracting apparatus is mounted to a side of the apparatus main body, the moving body is mounted to a side of a drawer portion, and the guiding member is mounted to a side of the apparatus main body or a side of the drawer portion.

Since the drawer apparatus is provided with the retracting apparatus in accordance with the first or second aspect of the present invention, as mentioned above, the drawer portion is automatically retracted to the retract end stably in the case of retracting (pressing) the drawer portion to the automatic retracting position.

In this case, mounting to the side of the apparatus main body or the side of the drawer portion means to mount to the apparatus main body or the drawer portion itself, and to indirectly mount to the apparatus main body or the drawer portion.

In accordance with a fourth aspect of the present invention, there is provided a sliding door apparatus comprising:

a fixed body fixed to a fixed side;

a moving body supported to the fixed body so as to be freely drawn and retracted with respect to the fixed body; and a sliding door supported to the moving body, wherein the sliding door apparatus is provided with the retracting apparatus as recited in the first or second aspect of the present invention, the fixed body of the retracting apparatus is mounted to a fixed side or a side of the sliding door, and the moving body is mounted to the side of the sliding door or the fixed side.

Since the sliding door apparatus is provided with the retracting apparatus in accordance with the first or second aspect of the present invention as mentioned above, the sliding door is automatically retracted to the retract end, that is, the close end or the open end stably, at a time when the sliding door is retracted to the predetermined close or open position.

In this case, mounting to the fixed side or the side of the sliding door means to mount to the fixed side or the sliding door itself, and to indirectly mount to the fixed side or the sliding door.

In accordance with a fifth aspect of the present invention, there is provided a retracting apparatus which is provided with a fixed body and a moving body supported to the fixed body so as to freely move from one moving end position to another moving end position, and is automatically retracted to the one moving end position or the another moving end position, in the case that the moving body moves toward the one moving end position or the another moving end position and reaches an automatic retract position a predetermined distance apart from the one moving end position or the another moving end position, comprising:

a driving member mounted to a side of the moving body or a side of the fixed body;

a sliding member engaged with the driving member and sliding;

a guiding member guiding the sliding member; and an energizing member energizing the sliding member to one moving side or another moving side, wherein the guiding member is provided with a guiding portion which guides the sliding member in a predetermined range of a moving body moving direction during a period that the moving body moves from one moving end position to an automatic retract position or from another moving end position to the automatic retract position, and a guiding groove having a large diameter portion formed in an end portion of the guiding portion in a direction of the one moving end position or a direction of the another end position such that a width is larger than a width of the guiding portion, the sliding member is provided with a sliding pin which is inserted through the guiding groove and slides along the guiding groove, the sliding pin of the sliding member slides along the guiding groove in accordance with movement of the moving body in the one moving end position direction or the another moving end position direction of the moving body, and rotates in the one moving end position direction or the another moving end position direction at the guiding groove end portion, whereby a dimension in an orthogonal direction to the guiding groove is changed, the sliding pin is fitted to the large diameter portion and locks the sliding member, an engagement between the sliding member and the driving member is cancelled, the driving member and the sliding member are engaged with each other at the automatic retract position on the basis of the movement of the moving body in the another moving end position direction or the one moving end position direction, and the lock of the sliding member is cancelled.

As mentioned above, in accordance with movement of the moving body in the one moving end position direction or the another moving end position direction, the sliding member is changed in the dimension in the orthogonal direction to the guiding groove of the sliding pin in the end portion in the one moving end position direction or the end portion in the another moving end position direction of the guiding groove, the sliding member is fitted to the large diameter portion and locks the sliding member, and the engagement between the sliding member and the driving member is cancelled. Accordingly, the sliding member is retracted to the one moving end position direction or the another moving end position direction without intention, and the automatic retracting function is not lost.

Further, since the sliding member energized by the energizing member in the one moving end position direction or the another moving end position direction slides along the guiding groove of the guiding member only in the moving direction of the moving body, the energizing member is not oscillated in the vertical direction and the horizontal direction, so that the apparatus can be structured compact. Further, it is preferable that the apparatus is assembled in a narrow guiding apparatus such as the slide rail, accordingly.

In accordance with a sixth aspect of the present invention, there is provided a retracting apparatus as recited in the fifth aspect of the present invention, wherein the sliding pin of the sliding member is allowed to rotate in the one moving end position direction or the another moving end position direction in the end portion in the side of the one moving end position or the end portion in the side of the another moving end position of the guiding groove, and the sliding member is pressed by the driving member so as to rotate around the sliding pin in the one moving end position direction or the another moving end position direction by moving the moving body in the one moving end position direction or the another moving end position direction, in the case that the sliding member is in the end portion in the side of the one moving end position or the end portion in the side of the another moving end position of the guiding groove in a state in which the engagement of the sliding member with the driving member is cancelled, whereby the engagement between the sliding member and the driving member is recovered.

As mentioned above, the structure is made such that the sliding member is pressed by the driving member so as to rotate around the sliding pin by moving the moving body in the one moving end position direction or the another moving end position direction, in the case that the sliding member is in the end portion in the side of the one moving end position or the end portion in the side of the another moving end position of the guiding groove in a state in which the engagement of the sliding member with the driving member is cancelled, whereby the engagement between the sliding member and the driving member is recovered. Accordingly, even in the case that the lock of the sliding member is cancelled for some reasons, the sliding member is retracted to the end portion in the side of the one moving end position or the end portion in the side of the another moving end position in the guiding groove of the guiding member by the energizing member, and the retracting function is lost, at a time when the moving body is at the one moving end position or the another moving end position, the retracting function can be recovered only by moving the moving body in the one moving end position direction or the another moving end position direction.

In accordance with a seventh aspect of the present invention, there is provided a drawer apparatus provided with a drawer portion which is freely drawn and retracted with respect to the apparatus main body, wherein the drawer apparatus is provided with the retracting apparatus as recited in the fifth or sixth aspect of the present invention, the fixed body of the retracting apparatus is formed as the apparatus main body or is mounted to the side of the apparatus main body, the moving body is formed as the drawer portion or is mounted to the side of the drawer portion, and the guiding member is mounted to the side of the apparatus main body or the side of the drawer portion.

As mentioned above, since the drawer apparatus is provided with the retracting apparatus for the sliding rail as described in the first aspect or the second aspect, the drawer portion is automatically retracted to the retract end position stably in the case of retracting (pressing) the drawer portion to the automatic retract position.

In accordance with an eighth aspect of the present invention, there is provided a sliding door apparatus comprising:

an apparatus main body; and a sliding door supported to the apparatus main body so as to be freely drawn and retracted, wherein the sliding door apparatus is provided with the retracting apparatus as recited in the fifth or sixth aspect of the present invention, the fixed body of the retracting apparatus is formed as the apparatus main body or is mounted to the side of the apparatus main body, and the moving body is formed as the sliding door or is mounted to the side of the sliding door.

As mentioned above, since the sliding door apparatus is provided with the retracting apparatus in accordance with the fifth or sixth aspect of the present invention, the sliding door can be automatically retracted to the one moving end position or the another moving end position, that is, the close end position or the open end position, at a time when the sliding door is moved to a predetermined position in the close direction or the open direction.

DESCRIPTION OF THE PREFERRED EMBODIMENT

Figure 1:
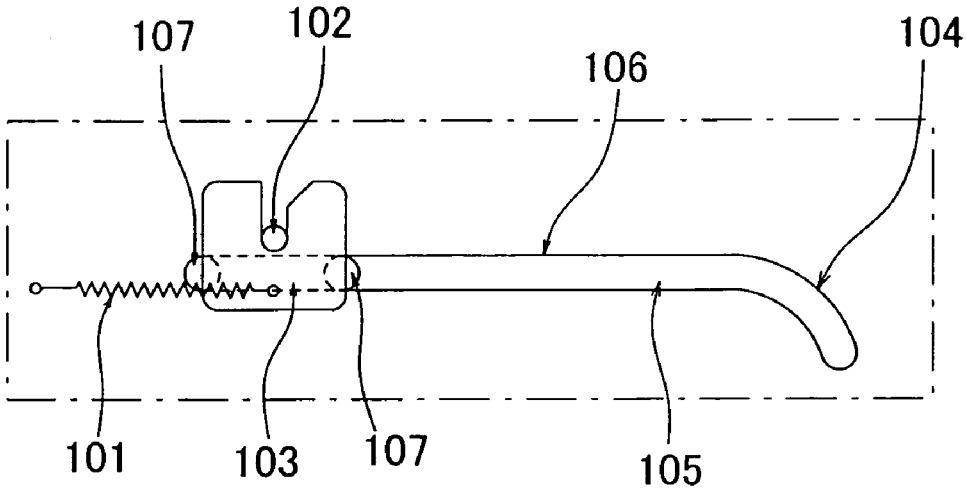
PRIOR ART Fig.1
FIG. 1 is a view showing a structure of a conventional closing apparatus for a drawer.
Figure 1:
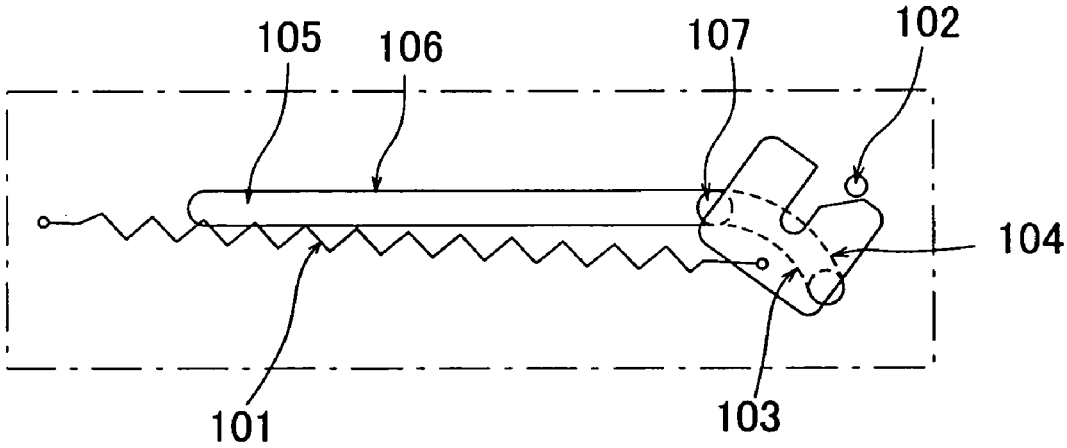
PRIOR ART Fig.1
Figure 2:
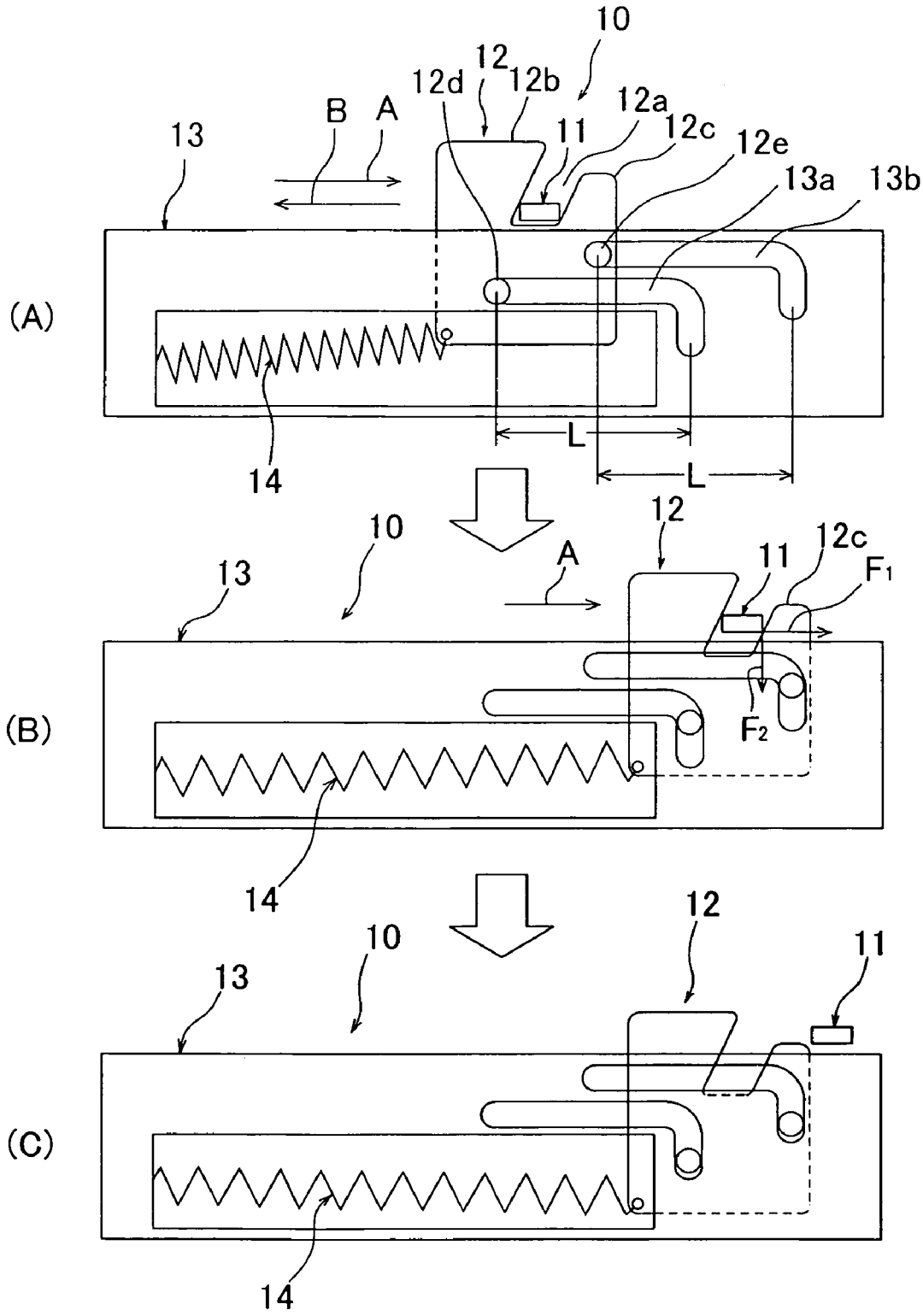
FIG. 2 is a view showing a structure example and an operation of a retracting apparatus in accordance with the present invention.
Figure 3:
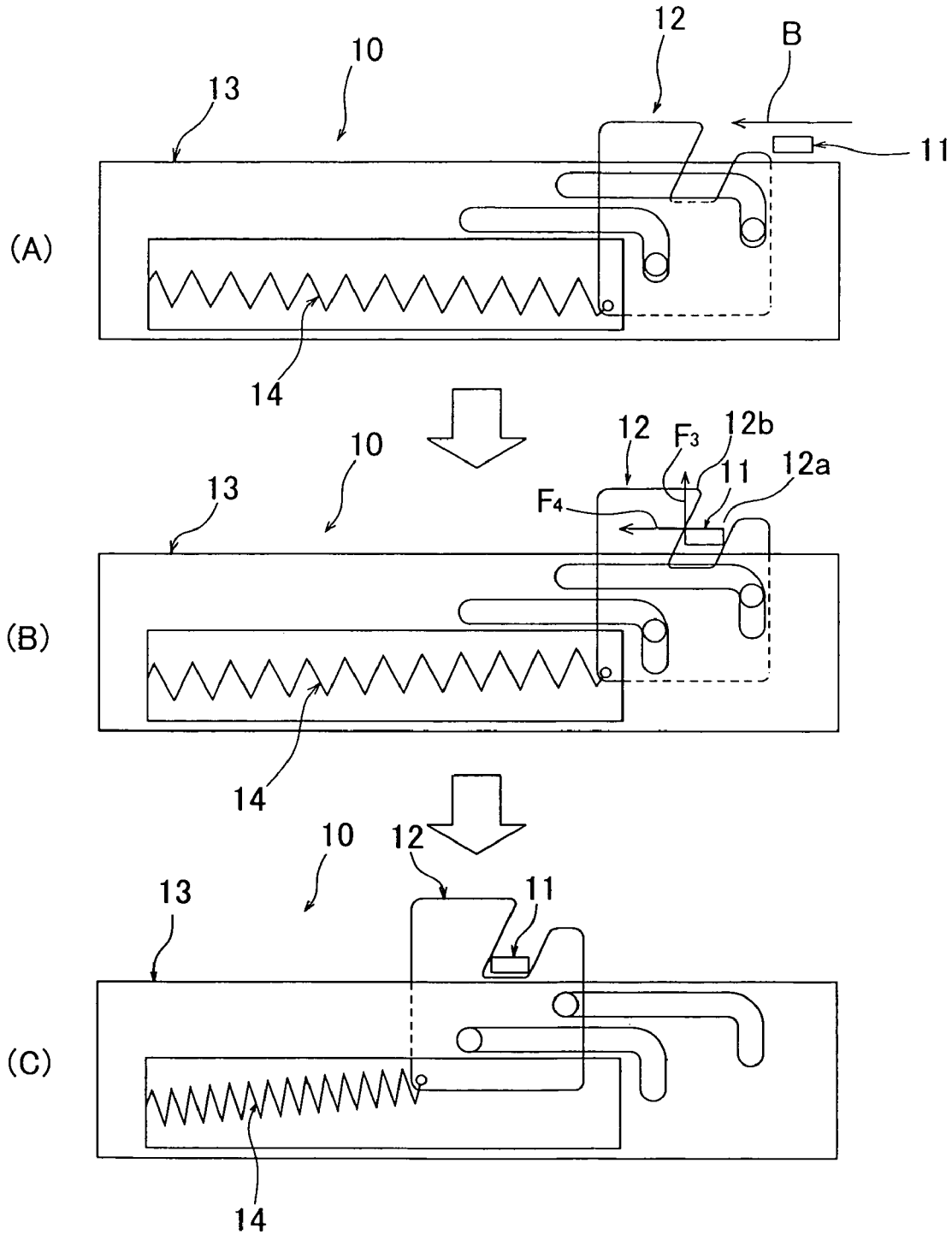
FIG. 3 is a view showing a structure example and an operation of the retracting apparatus in accordance with the present invention.

A description will be given below of an embodiment in accordance with the present invention with reference to the accompanying drawings. FIGS. 2 and 3 are views showing a structure and an operation of a retracting apparatus in accordance with the present invention.

A retracting apparatus 10 is provided with a driving member 11 moving interlocking with a moving rail (described in detail later) (not shown), an engagement member 12 engaging with the driving member 11, a guiding member 13 guiding the engagement member 12, and a coil spring 14 corresponding to an energizing member energizing the engagement member 12 in a retracting direction (an arrow B).

The engagement member 12 is constituted by a plate-shaped body, and is structured such that an engagement groove portion 12*a* engaged with the driving member 11 is formed in an upper portion thereof, a projection portion 12*b* having a predetermined height is provided in a retracting side (an arrow B side) with respect to the engagement groove portion 12*a*, and a projection portion 12*c* having a height a predetermined amount smaller than the height of the projection portion 12*b* is provided in a drawing side (an arrow A side).

Further, the engagement groove portion 12*a* is provided in a state in which the engagement groove portion 12*a* is inclined at a predetermined angle to the retracting side (the arrow B side) from an upper portion toward a lower portion.

Further, the engagement member 12 is provided with two sliding pins 12*d* and 12*e* having a circular cross sectional shape. A diameter of the sliding pins 12*d* and 12*e* is slightly smaller than a width of guiding grooves 13*a* and 13*b* of the guiding member 13 (at such a degree that the sliding pins 12*d* and 12*e* can smoothly slide along the guiding grooves 13*a* and 13*b*).

The guiding member 13 is provided with two guiding grooves 13*a* and 13*b* guiding the engagement member 12 within a predetermined range L in the drawing and retracting directions (the arrows A and B directions), during a period that the moving rail (not shown, and described later in detail) moves between a retract end position and an automatic retract position.

The guiding grooves 13*a* and 13*b* are constituted by two guiding grooves which are linearly formed in the predetermined ranges L and L in the drawing and retracting directions respectively, and are bent at a predetermined amount to an approximately vertical lower side in an end portion in the drawing direction.

Two sliding pins 12*d* and 12*e* of the engagement member 12 are respectively inserted to the guiding grooves 13*a* and 13*b* of the guiding member 13, and are structured such as to slide along the guiding grooves 13*a* and 13*b*.

Further, the coil spring 14 serving as the energizing member is structured such that one end thereof is mounted to the guiding member 13 (a fixed side), and another end is mounted to the engagement member 12.

In the retracting apparatus 10 having the structure mentioned above, the driving member 11 interlocking with the moving rail is moved in the drawing direction by moving (drawing) the moving rail (not shown) in the drawing direction (the arrow A direction). Accordingly, the projection portion 12*c* of the engagement member 12 is pressed by the driving member 11, and the sliding pins 12*d* and 12*e* of the engagement member 12 are guided and moved in the drawing direction along the guiding grooves 13*a* and 13*b* of the guiding member 13.

When the sliding pins 12*d* and 12*e* reach the end portion in the drawing direction of the guiding grooves 13*a* and 13*b*, the respective sliding pins 12*d* and 12*e* reach the approximately vertically lower bent portions of the guiding grooves 13*a* and 13*b*.

At this time, since the driving member 11 presses the inclined surface of the projection portion 12*c* in the engagement member 12 in a horizontal direction by a force F1, a component force F2 directed to a lower side is applied to the engagement member 12, and the sliding pins 12*d* and 12*e* move downward along the guiding grooves 13*a* and 13*b* on the basis of its own weight. When reaching a state shown in FIG. 2C, the driving member 11 breaks away from the projection portion 12*c* and moves in the drawing direction.

At this time, since the engagement member 12 is drawn in the retracting direction by an elastic force of the coil spring 14, the sliding pins 12*d* and 12*e* are brought into contact with the vertical descending surfaces of the guiding grooves 13*a* and 13*b* so as to be locked. At this time, since the sliding pins 12*d* and 12*e* are brought into contact with the vertical descending surfaces of the guiding grooves 13*a* and 13*b*, a lock state is stable and the sliding pins 12*d* and 12*e* are not retracted without intention.

The driving member 11 moves in the retracting direction by moving the moving rail in the retracting direction (the arrow B direction) from the drawn state, and reaches a state in FIG. 3B via a state in FIG. 3A. When further pressing the inclined surface of the projection portion 12*b* in the engagement member 12 in the retracting direction by a force F4, a pressing-up component force F3 is applied to the engagement member 12, and the engagement member 12 is pressed up to an upper side. When the sliding pins 12*d* and 12*e* reach the horizontal portions (the linear portions) of the guiding grooves 13*a* and 13*b* in the guiding member 13, the lock of the engagement member 12 is cancelled, and the engagement member 12 is drawn in the retracting direction by the elastic force of the coil spring 14, and is automatically retracted to the retract end as shown in FIG. 3C.

Figure 4:
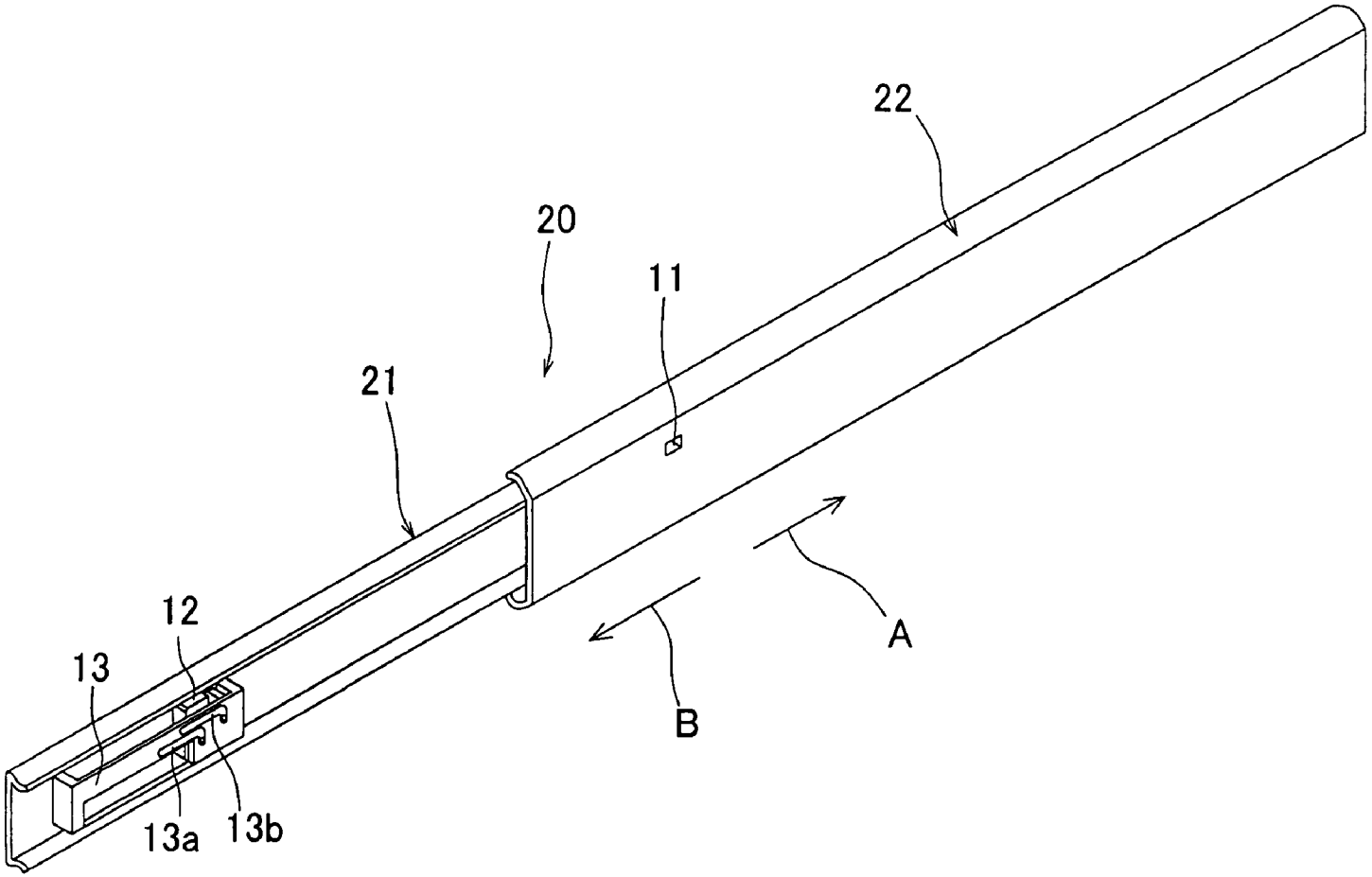
FIG. 4 is a perspective view of an outer appearance showing a structure example of a retracting apparatus in a sliding rail in accordance with the present invention.
Figure 5:
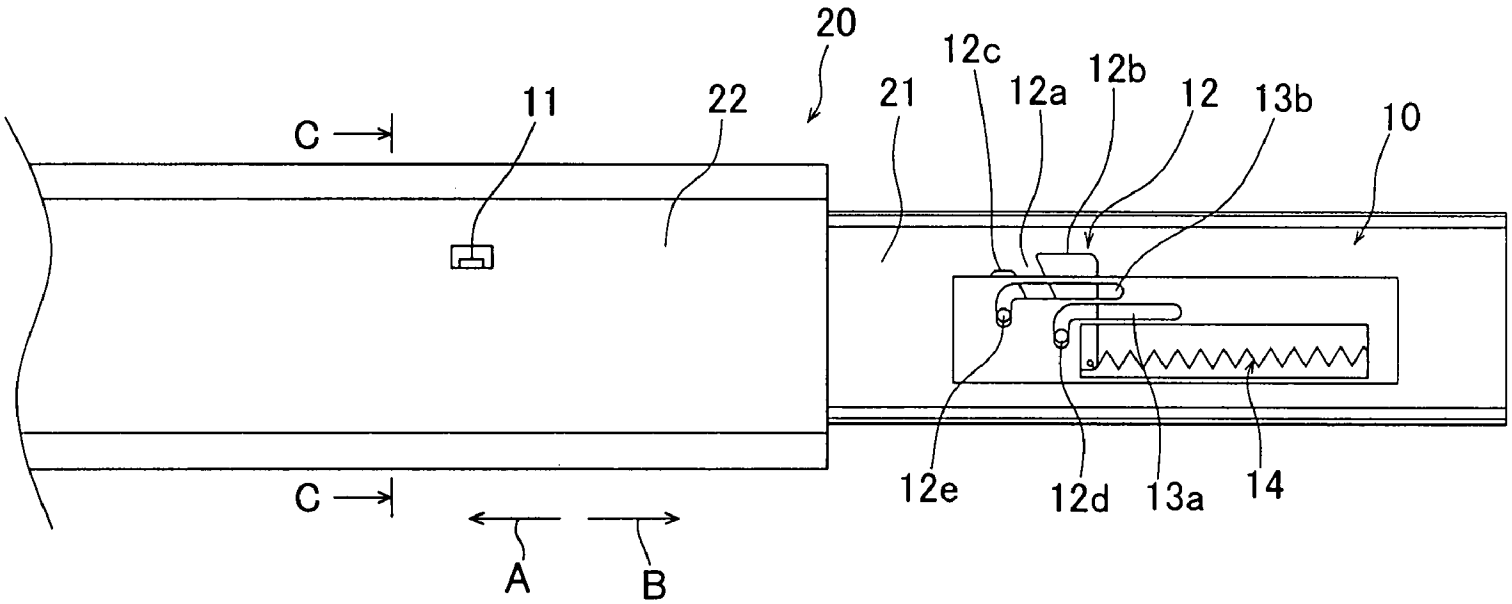
FIG. 5 is a side elevational view showing a part of the structure example of the retracting apparatus in the sliding rail in accordance with the present invention.
Figure 6:
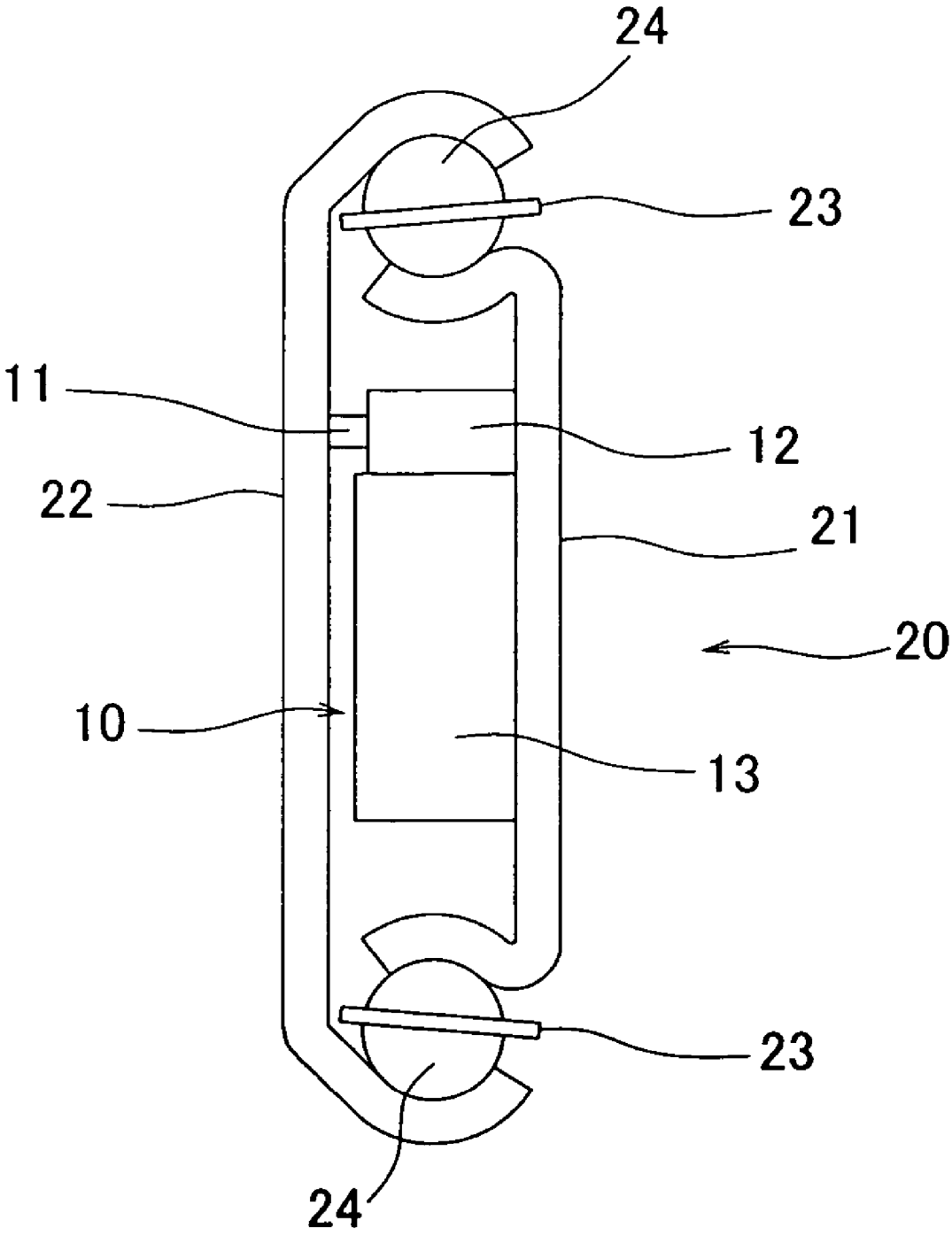
FIG. 6 is a cross sectional view along a line C—C in FIG. 5.

FIGS. 4 to 6 are views showing the structure example in which the retracting apparatus having the structure shown in FIGS. 2 and 3 is provided in the sliding rail so as to be formed as the retracting apparatus of the sliding rail, in which FIG. 4 is a schematic view of an outer appearance, FIG. 5 is a side elevational view of a part thereof, and FIG. 6 is a cross sectional perspective view along a line C—C in FIG. 5.

As illustrated, the sliding rail 20 is structured such as to be provided with an inner rail 21 and an outer rail 22. The inner rail 21 may be formed as a fixed rail or may be formed as a moving rail. Further, the outer rail 22 may be formed as the moving rail or may be formed as the fixed rail. In this case, as a matter of convenience for explanation, the outer rail 22 is set to the moving rail, the inner rail 21 is set to the fixed rail. The outer rail 22 is supported to the inner rail 21 so as to be freely drawn and retracted.

In other words, the inner rail 21 having an approximately C-shaped cross section is received such that an opening portion thereof is opposed to an opening portion of the outer rail 22, a lot of balls 24 held by a retainer 23 are interposed between an inner peripheral surface of the outer rail 22 and an outer peripheral surface of the inner rail 21, and the outer rail 22 is supported to the inner rail 21 so as to freely slide in a longitudinal direction (in a drawing and retracting direction).

The guiding member 13 of the retracting apparatus 10 is fixed to the opening portion of the inner rail 21 having the approximately C-shaped cross section and forming the fixed rail, and the driving member 11 of the retracting apparatus 10 is provided in the opening surface of the outer rail 22 having the approximately C-shaped cross section and forming the moving rail so as to protrude to the side of the inner rail 21.

FIGS. 4 and 5 show a state in which the outer rail 22 corresponding to the moving rail is drawn in the retracting direction (a direction of an arrow A in FIG. 2). In this state, the engagement member 12 of the retracting apparatus 10 is in a lock state as shown in FIG. 2C such that the sliding pins 12*d* and 12*e* are drawn by the elastic force of the coil spring 14 and are brought into contact with the vertically descending portions of the guiding grooves 13*a* and 13*b* in the guiding member 13.

In this case, although an illustration is omitted, the driving member 11 may be provided in the inner rail 21 and the guiding member 13 may be provided in the outer rail 22.

When pressing the outer rail 22 corresponding to the moving rail in the retracting direction (a direction of an arrow B), the driving member 11 also moves in the retracting direction. When reaching the state in FIG. 3B from the state in FIG. 3A, the engagement member 12 is pressed up to the upper side. When the sliding pins 12*d* and 12*e* reach the horizontal portions (the linear portions) of the guiding grooves 13*a* and 13*b* in the guiding member 13, the engagement member 12 is drawn in the retracting direction on the basis of the elastic force of the coil spring 14, and is automatically retracted to the retract end as shown in FIG. 3C.

Figure 7:
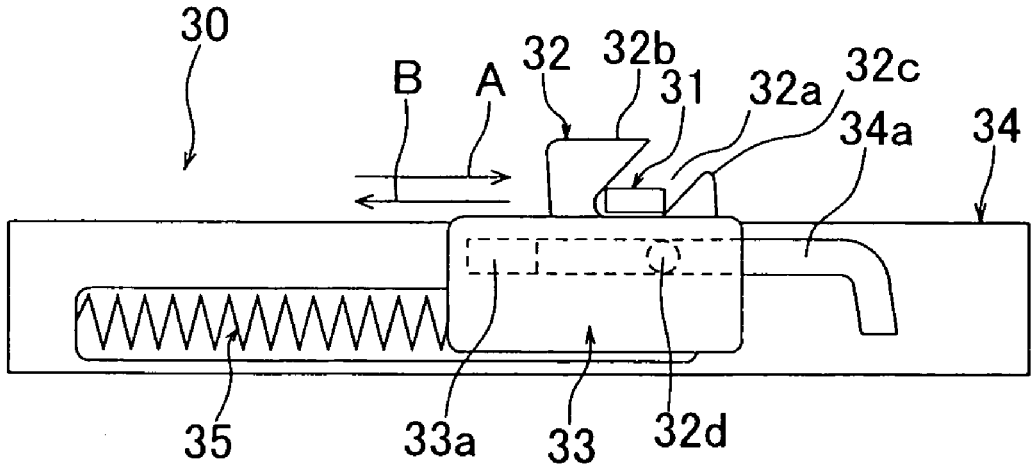
FIG. 7 is a view showing a structure example of the retracting apparatus in accordance with the present invention.
Figure 8:
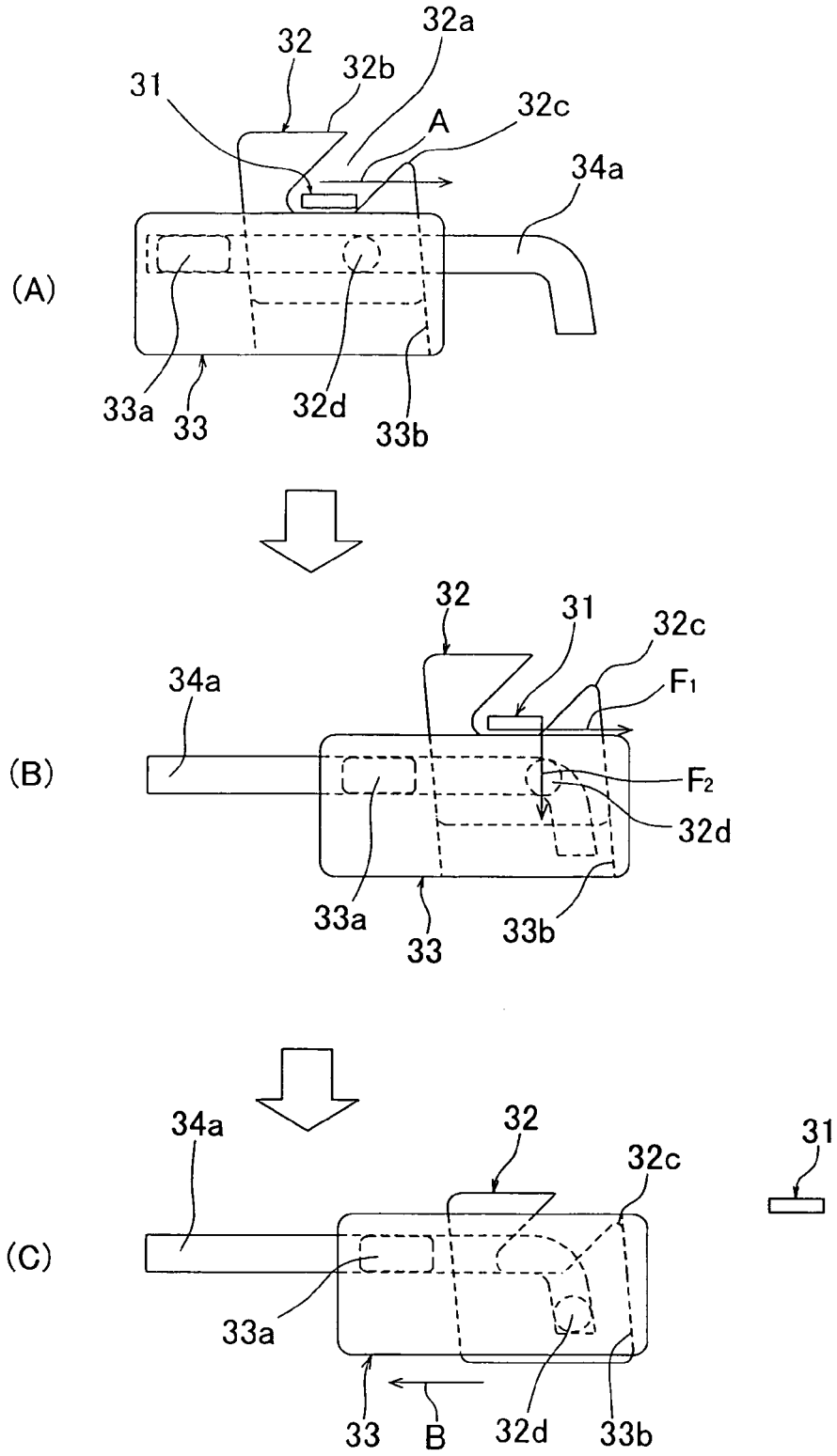
FIG. 8 is a view showing an operation of the retracting apparatus in accordance with the present invention.
Figure 9:
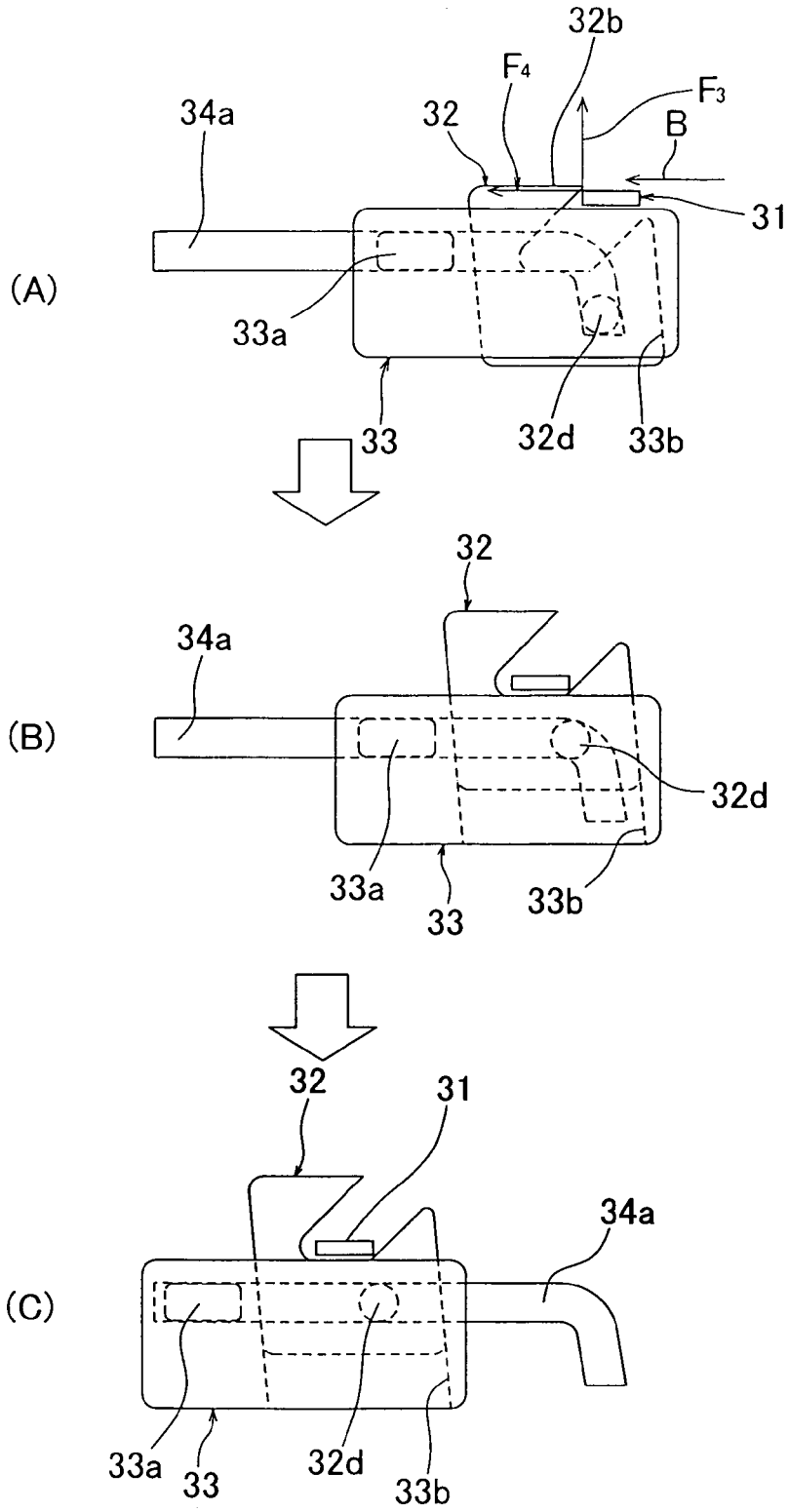
FIG. 9 is a view showing an operation of the retracting apparatus in accordance with the present invention.

FIG. 7 is a view showing another structure example of the retracting apparatus in accordance with the present invention, and FIGS. 8 and 9 are views for explaining an operation thereof. A retracting apparatus 30 is structured such as to be provided with a driving member 31 moving interlocking with a moving rail (not shown), an engagement member 32 engaging with the driving member 31, a sliding member 33 with which the engagement member 32 is engaged, a guiding member 34 guiding the sliding member 33, and a coil spring 35 corresponding to an energizing member energizing the sliding member 33 in a retracting direction (an arrow B).

The engagement member 32 is constituted by a plate-shaped body, and is structured such that an engagement groove portion 32*a* engaged with the driving member 31 is formed in an upper portion thereof, a projection portion 32*b* having a predetermined height is provided in a retracting side (an arrow B side) with respect to the engagement groove portion 32*a*, and a projection portion 32*c* having a height a predetermined amount smaller than the height of the projection portion 32*b* is provided in a drawing side (an arrow A side).

Further, the engagement groove portion 32*a* is provided in a state in which the engagement groove portion 32*a* is inclined at a predetermined angle to the retracting side (the arrow B side) from an upper portion toward a lower portion.

The guiding member 34 is provided with one guiding groove 34*a* guiding the sliding member 33 within a predetermined range in the drawing and retracting directions (the arrows A and B directions), during a period that the moving rail moves between a retract end position and an automatic retract position.

The guiding grooves 34*a* is constituted by a guiding groove which is linearly formed in the predetermined range in the drawing and retracting directions, and is bent at a predetermined amount to an approximately vertical lower side in an end portion in the drawing direction.

The engagement member 32 and the sliding member 33 are respectively provided with a sliding pin 32*d* and a sliding pin 33*a* which slide along the guiding groove 34*a*.

The sliding pin 32*d* is formed such that a cross sectional shape is a circular shape and a diameter thereof is slightly smaller (at a smoothly sliding amount) than a width of the guiding groove 34*a*, and the sliding pin 33*a* is formed such that a cross sectional shape is a rectangular shape and a width thereof is slightly smaller (at a smoothly sliding amount) than a width of the guiding groove 34*a*.

The sliding member 33 is provided with a sliding groove 33*b* along which the engagement member 32 slides in an approximately vertical direction.

In the retracting apparatus 30 having the structure mentioned above, the driving member 31 interlocking with the moving rail is moved in the drawing direction (the arrow A direction), as shown in FIG. 8A, by moving (drawing) the moving rail (not shown) in the drawing direction. Accordingly, the projection portion 32*c* of the engagement member 32 is pressed by the driving member 31, and the engagement member 32 is moved by being guided by the movement of the sliding pin 32*d* thereof in the drawing direction along the guiding groove 34*a* of the sliding member 33, and the sliding member 33 with which the engagement member 32 is engaged via the sliding groove 33*b* is moved by being guide by the movement of the sliding pin 33*a* thereof in the drawing direction along the guiding groove 34*a*.

When the sliding pin 32*d* reaches the end portion in the drawing direction of the guiding grooves 34*a*, as shown in FIG. 8B, the sliding pin 32*d* reaches the approximately vertically lower bent portion of the guiding groove 34*a*.

At this time, since the driving member 31 presses the inclined surface of the projection portion 32*c* in the engagement member 32 in the drawing direction by a force F1, a component force F2 directed to a lower side is applied to the engagement member 32, and the sliding pin 32*d* moves downward along the guiding groove 34*a* on the basis of its own weight.

When reaching a state shown in FIG. 8C, the driving member 31 breaks away from the projection portion 32*c* and moves in the drawing direction. At this time, since the sliding member 33 is drawn in the retracting direction (in the arrow B direction) by an elastic force of a coil spring 35 (refer to FIG. 7), the sliding pin 32*d* of the engagement member 32 engaged with the sliding member via the sliding groove 33*b* is brought into contact with the vertical descending surface of the guiding groove 34*a* so as to be locked.

At this time, since the sliding member 33 only moves along the linear portion of the guiding groove 34*a*, the coil spring 35 does not oscillate in the vertical direction, so that it is possible to structure the retracting apparatus compact at that degree, and it is possible to obtain a structure which is preferably assembled in a narrow guiding apparatus such as a sliding rail.

As shown in FIG. 8C, in the case of moving the moving rail in the retracting direction (in the arrow B direction) in a state in which the engagement member 32 is in a locked state, the driving member 31 reaches a state in FIG. 9A, and when further pressing the inclined surface of the projection portion 32*b* in the engagement member 32 in the retracting direction by a force F4, a pressing up component force F3 is applied to the engagement member 32, the engagement member 32 is pressed up. When the sliding pin 32*d* reaches the horizontal portion (the linear portion) of the guiding groove 34*a* in the guiding member 34, the sliding member 33 is drawn in the retracting direction by the elastic force of the coil spring 35, and is automatically retracted to the retract end as shown in FIG. 9C.

The retracting apparatus 30 having the structure mentioned above achieves the same operations and effects as those of the retracting apparatus of the sliding rail 20 shown in FIGS. 4 to 6, by being mounted in place of the retracting apparatus 10 of the sliding rail having the structure shown in FIGS. 4 to 6. Further, in the case of the retracting apparatus 30, since the sliding member 33 does not move in the vertical direction as mentioned above, the coil spring 35 does not oscillate in the vertical direction, so that it is possible to structure the apparatus compact, and the apparatus is preferably mounted to the narrow sliding rail.

In the case of using the retracting apparatus of the sliding rail having the structure mounted to the sliding rail 20 to which the retracting apparatus 10 or the retracting apparatus 30 is mounted, as a retracting apparatus in a drawer apparatus such as a furniture or the like, which is not illustrated, the inner rail 21 corresponding to the fixed rail is mounted to the side of the apparatus main body, the outer rail 22 corresponding to the moving rail is mounted to the side of the drawer portion, and the guiding member 13 or the guiding member 34 is mounted to the side of the apparatus main body. Accordingly, in the case of pushing in the drawer portion to a predetermined automatic retract position from a drawn state, the drawer portion is retracted to the retract end.

Further, since the retracting apparatus 10 and the retracting apparatus 30 are not retracted without intention as mentioned above, the recovering mechanism is not required, and the structure of an entire of the structure is simple.

Further, in the case of using the retracting apparatus of the sliding rail having the structure mounted to the sliding rail 20 to which the retracting apparatus 10 or the retracting apparatus 30 is mounted, for a sliding door apparatus provided with a sliding door mounted to an apparatus main body such as a wall of a building or the like so as to be freely drawn and retracted, which is not illustrated, the inner rail 21 corresponding to the fixed rail is mounted to the fixed side, the outer rail 22 corresponding to the moving rail is mounted to the side of the sliding door, and the guiding member 13 or the guiding member 34 is mounted to the fixed side.

Since the retracting apparatus of the sliding rail is provided in the sliding door apparatus as mentioned above, it is possible to provide the sliding door apparatus which can be automatically retracted to the retract end, that is, the close end or the open end, stably, in the case that the sliding door is retracted to the predetermined close or open position, and it is possible to prevent the sliding door from being left in a partly close state and in a partly open state.

Figure 10:
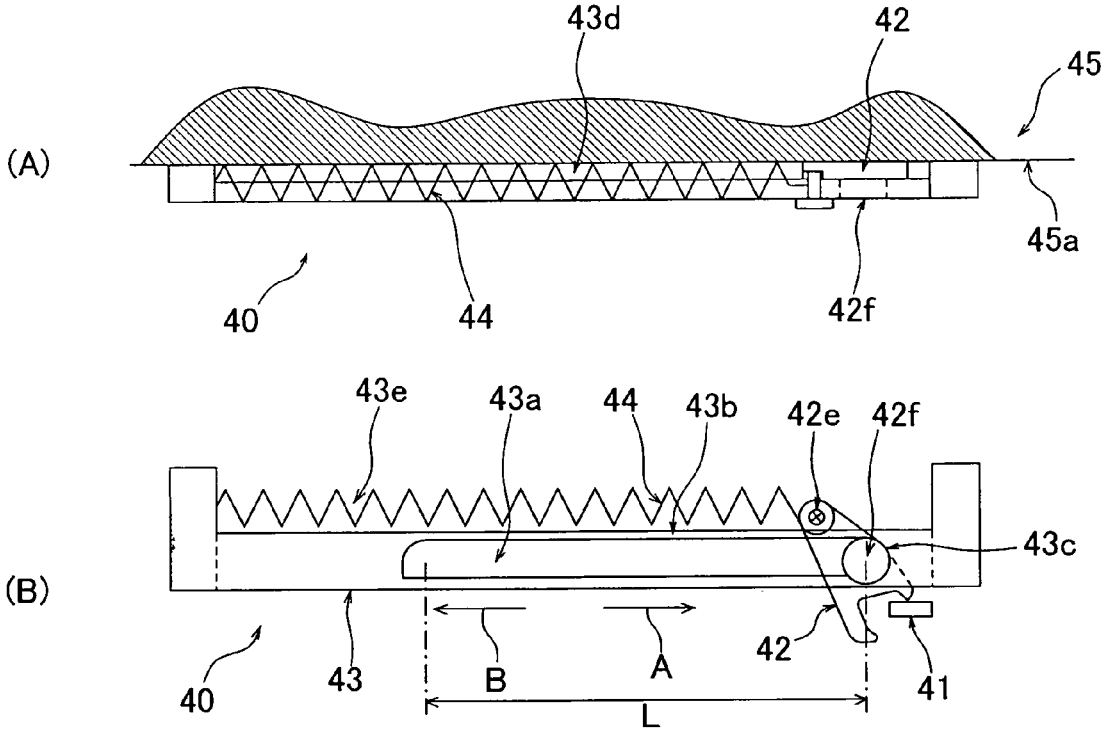
FIG. 10 is a view showing a structure example of the retracting apparatus in accordance with the present invention.
Figure 11:
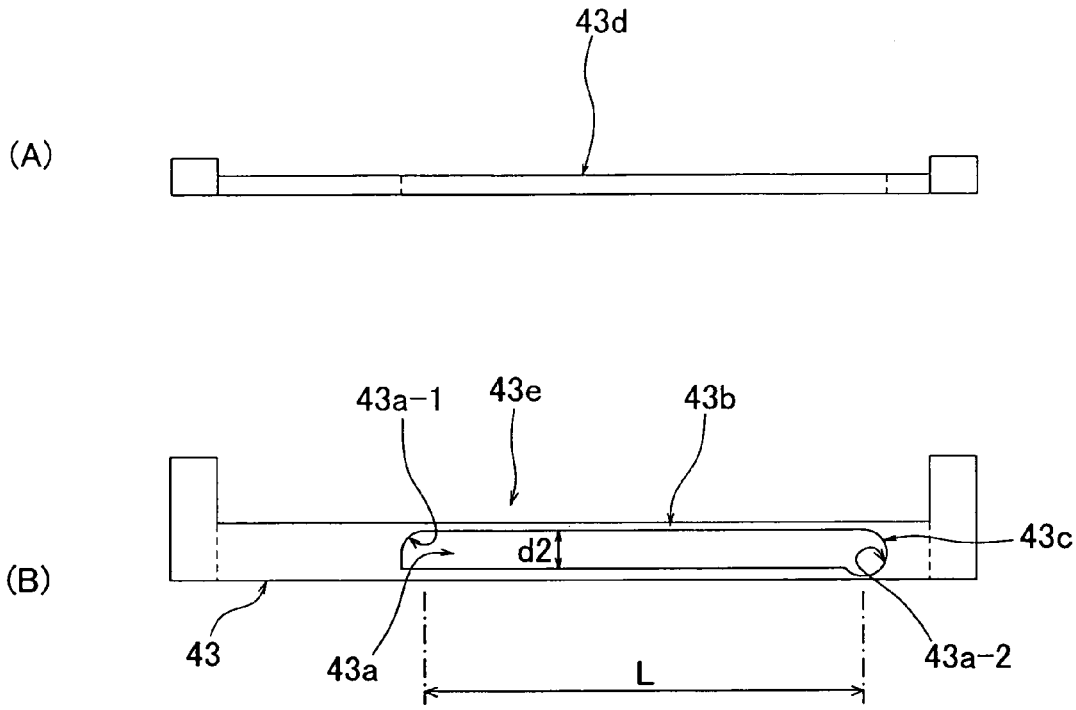
FIG. 11 is a view showing a structure example of a guiding member of the retracting apparatus in accordance with the present invention.
Figure 12:
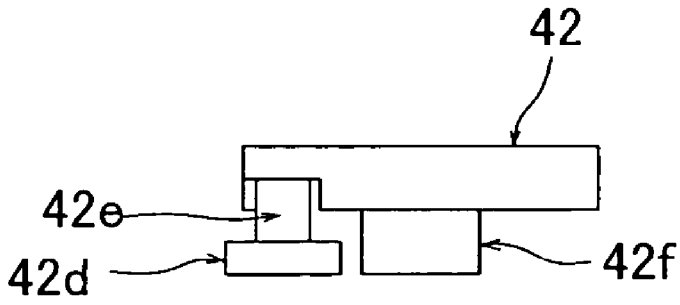
FIG. 12 is a view showing a structure example of a sliding member of the retracting apparatus in accordance with the present invention.
Figure 12:
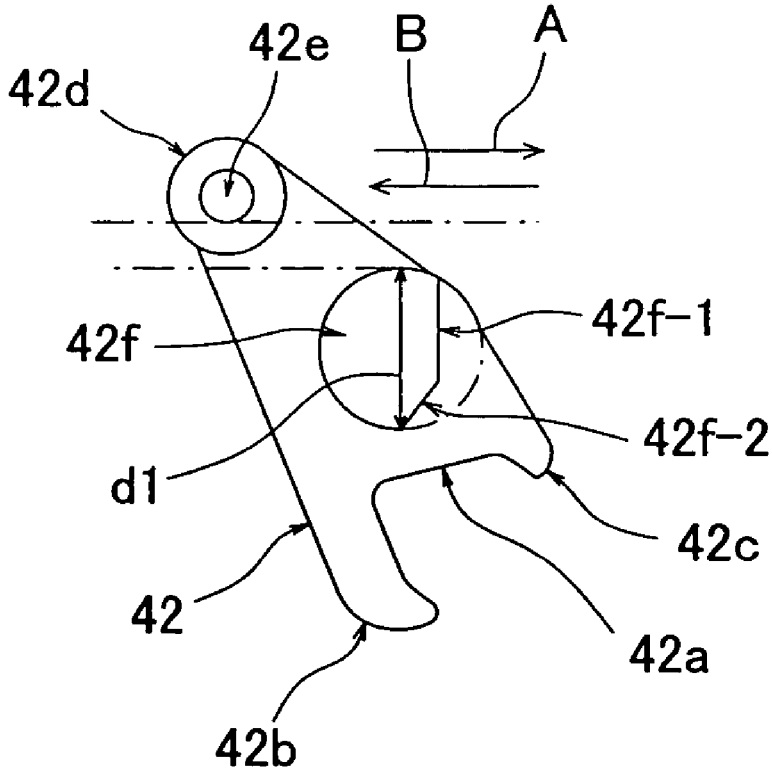

FIG. 10 is a view showing an example of the other structure of the retracting apparatus in accordance with the present invention, in which FIG. 10A is a plan view, and FIG. 10B is a front elevational view. FIG. 11 is a view showing a structure of a guiding member of the retracting apparatus, in which FIG. 11A is a plan view and FIG. 11B is a front elevational view. FIG. 12 is a view showing a structure of a sliding member of the retracting apparatus, in which FIG. 12A is a plan view and FIG. 12B is a front elevational view. As shown in FIG. 10, the retracting apparatus 40 is provided with a driving member 41 moving interlocking with a moving body (not shown), a sliding member 42 engaged with the driving member 41, a guiding member 43 guiding the sliding member 42, and a coil spring 44 corresponding to an energizing member energizing the sliding member 42 in a direction of one moving end position (in a direction of an arrow B).

In this case, the moving body mentioned above is supported to a fixed rail 45 (refer to FIG. 10A) so as to freely move between one moving end position and another moving end position by a sliding rail, a roller or the like.

The sliding member 42 is formed in a plate body shape as shown in FIG. 12, and is structured such that an engagement groove portion 42*a* with which the driving member 41 is engaged is formed in one end portion, a projection portion 42*b* having a predetermined height is provided in one moving end position side (an arrow B side) with respect to the engagement groove portion 42*a*, and a projection portion 42*c* having a height a predetermined amount smaller than the height of the projection portion 12*b* is provided in another moving end position side (an arrow A side).

Further, a pin 42*e* having a disc-shaped collar 42*d* in a leading end thereof is provided in another end of the sliding member 42, and a sliding pin 42*f* is provided in a center portion thereof. The sliding pin 42*f* has a flat notched surface 42*f*-1 formed in an outer periphery of a circular column having a diameter d1, and a flat notch surface 42*f*-2 formed in a side portion of the flat notched surface 42*f*-1 at a predetermined angle, and is formed in a partly notched circular cross sectional shape.

The guiding member 43 is provided with a guiding groove 43*a* which guides the sliding member 42 within a predetermined range L in a moving body moving direction (directions of arrows A and B), during a period that the moving body (not shown) moves between one moving end position and an automatic retract position which is a predetermined distance apart from the one moving end position.

The guiding groove 43*a* is structured such that a width in a direction orthogonal to a longitudinal direction is d2, an upper half of the end portion in the one moving end position direction is formed in a circular arc 43*a*-1 having a diameter equal to the diameter d1 of the sliding pin 42*f*, and the end portion in the another moving end position direction is formed in a circular arc 43*a*-2 having a diameter equal to the diameter of the sliding pin 42*f* so as to form a large-diameter portion 43*c*.

In this case, the diameter d1 of the sliding pin 42*f* is larger than the width d2 of the guiding groove 43*a* (d1>d2). The upper portion 43*b* of the guiding groove 43*a* in the guiding member 43 is positioned between the pin 42*e* and the sliding pin 42*f* in the sliding member 42.

Further, the sliding pin 42*f* of the sliding member 42 is inserted through the guiding groove 43*a*, and is slid in the one moving end position direction and the another moving end position direction along the guiding groove 43*a*.

Further, a recess portion 43*d* for receiving the sliding member is formed in a back surface of the guiding member 43, and a space for receiving the sliding member 42 is formed between a mounting surface 45*a* of the fixed rail 45 and the guiding member 43, as shown in FIG. 10A, by mounting the recess portion 43*d* so as to oppose to the mounting surface 45*a* of the fixed rail 45.

Further, a recess portion 43*e* for arranging the coil spring 44 corresponding to the energizing member is formed in a top surface of the guiding member 43.

One end of the coil spring 44 is mounted to the end portion in the one moving end position direction of the guiding member 43, and another end thereof is mounted to the pin 42*e* of the sliding member. Accordingly, the sliding member 42 is energized in the one moving end position direction by the elastic force of the coil spring 44.

Figure 13:
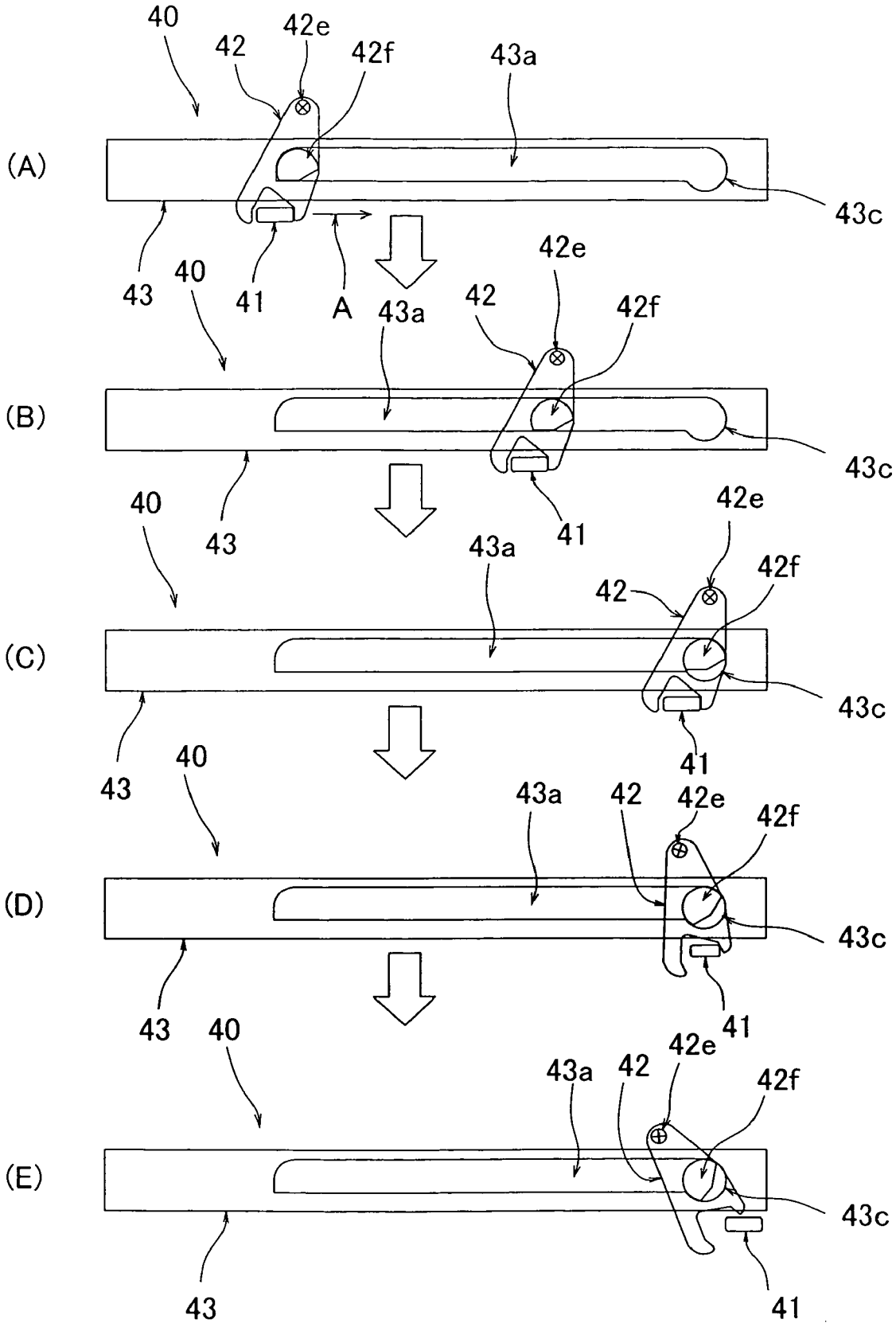
FIG. 13 is a view showing a drawing operation of the retracting apparatus in accordance with the present invention.

A description will be given of an operation of the retracting apparatus having the structure mentioned above with reference to FIG. 13. FIG. 13 is a view showing an operation in the another moving end position direction. In this case, in FIG. 13, the coil spring 44 is omitted, and both end portions of the guiding member 43 are omitted. As shown in FIG. 13A, in the case that the sliding member 42 exists in the end portion in the retracting direction of the guiding member 43, the flat notched surface 42*f*-2 of the sliding member 42 is brought into contact with the lower surface of the guiding groove 43*a*, and the circular arc outer peripheral surface is brought into contact with the top surface of the guiding groove 43*a* and the surface of the end portion circular arc 43*a*-1, as shown in FIG. 14A.

In this case, a dimension d3 from the flat notched surface 42*f*-2 of the sliding member 42 to the highest point of the outer peripheral circular arc orthogonal to the surface is slightly smaller than a width d2 of the guiding groove 43*a* (in order to make the sliding pin 42*f* to smoothly move along the guiding groove 43*a*).

Figure 14:
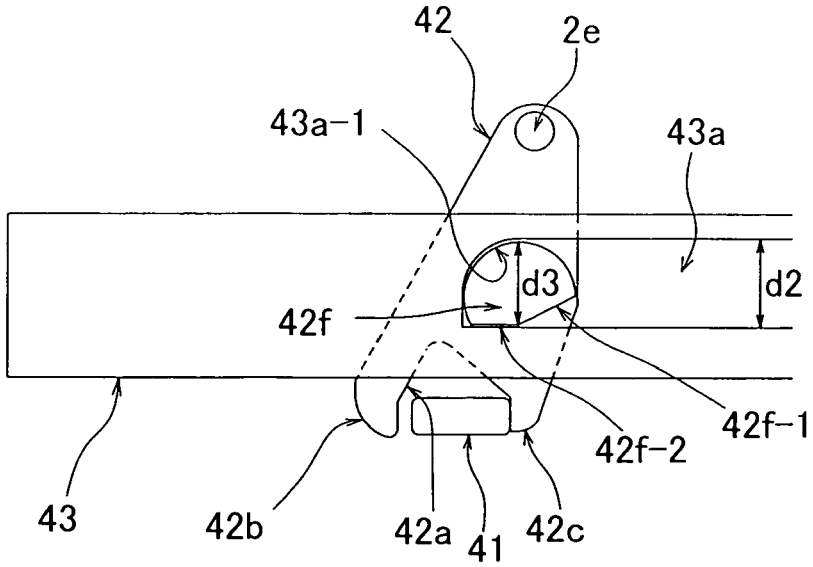
FIG. 14 is a view showing an operation of the sliding member of the retracting apparatus in accordance with the present invention.
Figure 14:
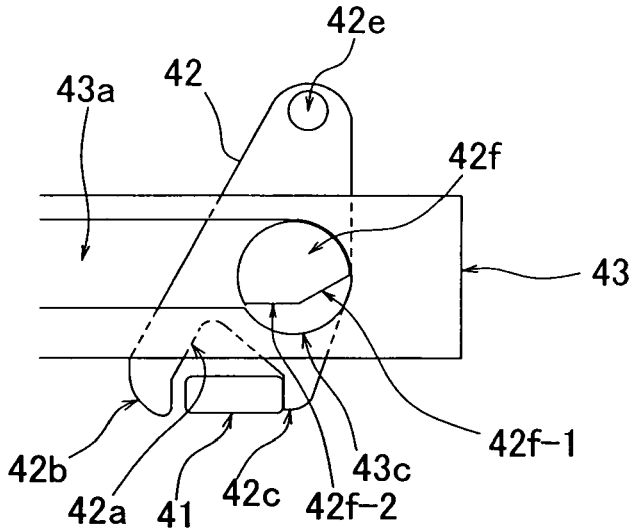
Figure 14:
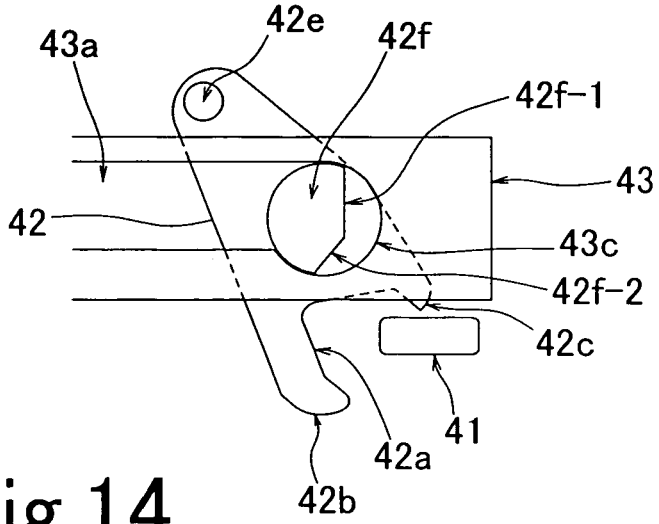

When moving the moving body (not shown) in the another moving end position direction (in the direction of the arrow A), as shown in FIG. 13B from the state in FIG. 13A, the driving member 41 moves in the same direction, and the sliding member 42 moves along the guiding groove 43*a* in a state in which the sliding pin 42*f* is in a state (attitude) shown in FIG. 14A.

Further, the sliding pin 42*f* reaches the end portion in the side of the another moving end position of the guiding groove 43*a*, as shown in FIG. 13C. In this state, when the driving member 41 further moves in the another moving end position direction, the sliding member 42 is drawn by the driving member 41 and the sliding pin 42*f* rotates in the large-diameter portion 43*c* of the guiding groove 43*a*, as shown in FIGS. 13D and 13E.

Details of this operation will be shown in FIGS. 14B and 14C. Since the diameter d1 of the sliding pin 42*f* becomes larger than the width d2 of the guiding groove 43*a* (d1>d2) as mentioned above, the sliding pin 42*f*, that is, the sliding member 42 is locked by the large-diameter portion 43*c* in the another moving end position side end portion of the guiding groove 43*a*. At this time, since the projection portion 42*c* of the sliding member 42 is positioned above the position of the driving member 41, the engagement between the sliding member 42 and the driving member 41 is cancelled.

Next, a description will be given of an operation of the retracting apparatus in the one moving end position direction with reference to FIG. 15. When moving the moving body (not shown) in the one moving end position direction (the direction of the arrow B), the driving member 41 moves in the same direction as shown in FIG. 15A.

Further, as shown in FIG. 15B, when the driving member 41 passes through the position of the projection portion 12*c* in the sliding member 42, and is brought into contact with the projection portion 42*b*, and the driving member 41 further moves, the sliding member 42 rotates around the sliding pin 42*f* as shown in FIG. 15C.

Further, when the flat notched surface 42*f*-2 of the sliding pin 42*f* is aligned with the lower surface of the guiding groove 43*a* in the guiding member 43 (refer to FIG. 14B), the lock of the sliding member 42 is cancelled, the driving member 41 enters into the engagement groove portion 42*a* of the sliding member 42, and the driving member 41 and the sliding member 42 are engaged with each other.

Accordingly, since the sliding member 42 is retracted in the one moving end position direction by the elastic force of the coil spring 44, as shown in FIG. 15D, the driving member 41 and the moving rail are retracted in the same manner, and are retracted to the one moving end position side end portion of the guiding groove 13, as shown in FIG. 15E.

Figure 16:
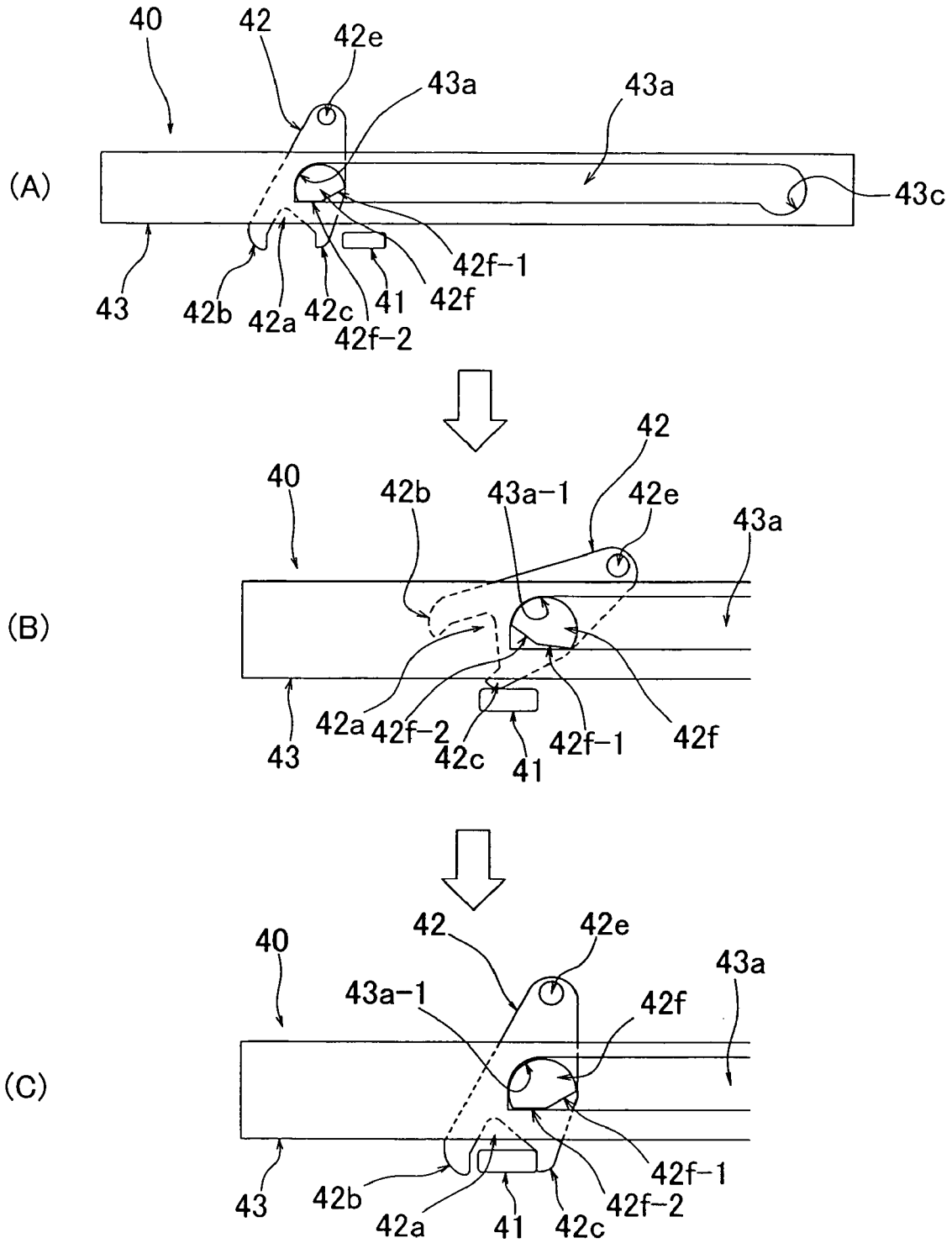
FIG. 16 is a view showing a recovering operation of a retracting function of the retracting apparatus in accordance with the present invention.

Next, a description will be given of an operation for recovering the engagement between the sliding member 42 and the driving member 41 in the case that the sliding member 42 in FIG. 13E is cancelled in locking from the locked state without relation to the movement of the moving body in the one moving end position direction for some reasons, and is retracted to the one moving end position side end portion of the guiding groove 13*a*, as shown in FIG. 16A.

In this case, as shown in FIG. 16B, the projection portion 42*c* of the sliding member 42 is pressed by the driving member 41 by moving the moving body in the one moving end position direction so as to move the driving member 41 in the same direction, whereby the sliding member 42 rotates around the sliding pin 42*f*.

Further, when the driving member 41 passes through the position of the projection portion 42*c*, the sliding member 42 rotates in an opposite direction, and the driving member 41 is positioned within the engagement grove portion 42*a* of the sliding member 42, as shown in FIG. 16C. accordingly, the engagement between the driving member 41 and the sliding member 42 is recovered.

This is because the flat notched surface 42*f*-1 and the flat notched surface 42*f*-2 are provided in the outer peripheral surface of the sliding pin 42*f* in the sliding member 42, and it is possible to rotate from the state in FIG. 16A in which the flat notched surface 42*f*-2 is in contact with the lower surface of the guiding groove 43*a* in the one moving end position direction end portion of the guiding groove 43*a* to the state in which the flat notched surface 42*f*-1 is in contact with the lower surface of the guiding groove 43*a*, as shown in FIG. 16B.

Figure 15:
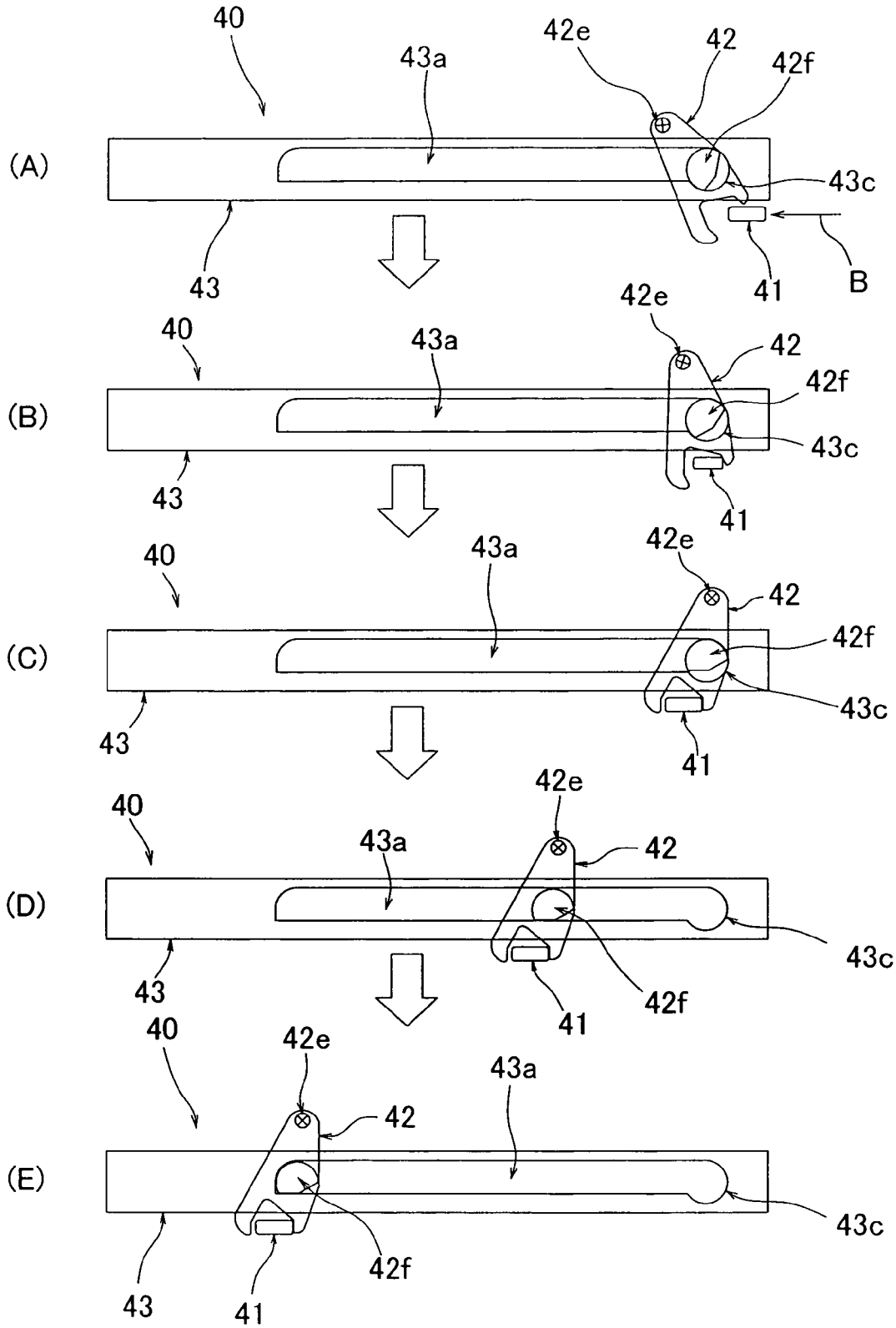
FIG. 15 is a view showing a retracting operation of the retracting apparatus in accordance with the present invention.

In the example mentioned above, there is shown the example in which in the case that the moving body which is not illustrated moves with respect to the fixed body from the one moving end position toward the another moving end position (moves in the direction of the arrow A), as shown in FIGS. 13 and 15, the sliding member 42 is locked in the another moving end position side end portion of the guiding groove 43*a*, the engagement between the sliding member 42 and the driving member 41 is cancelled, the lock of the sliding member 42 is cancelled at the automatic retract position a predetermined distance apart form the one moving end position on the basis of the movement of the moving body in the one moving end position direction (the movement in the direction of the arrow B), and the sliding member 42 and the driving member 41 are engaged with each other. However, although an illustration is omitted, the structure may be inversely made such that in the case of moving from the another moving end position to the one moving end position (moving in the direction of the arrow B), the sliding member 42 is locked in the one moving end position side end portion of the guiding groove 43*a*, the engagement between the sliding member 42 and the driving member 41 is cancelled, the lock of the sliding member 42 is cancelled at the automatic retract position which is a predetermined distance apart from the another moving end position on the basis of the movement of the moving body in the another moving end position direction (the movement in the direction of the arrow A), and the sliding member 42 and the driving member 41 are engaged with each other.

In this case, the large-diameter portion 43*c* is provided in the one moving end position side end portion of the guiding groove 43*a*, and the sliding member 42 is energized by the coil spring 44 in the another moving end position direction.

Figure 17:
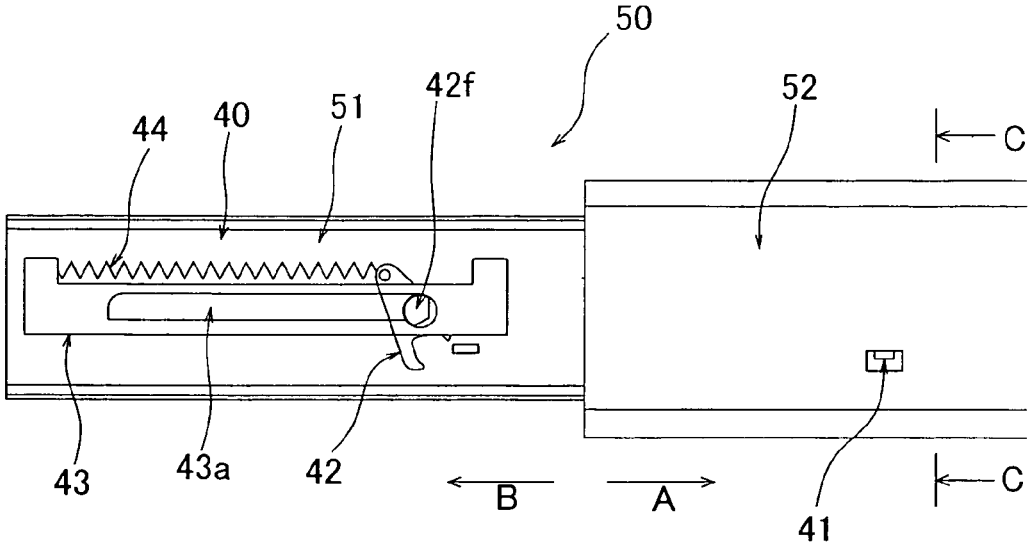
FIG. 17 is a view showing a structure example of the retracting apparatus of the sliding rail in accordance with the present invention.
Figure 17:
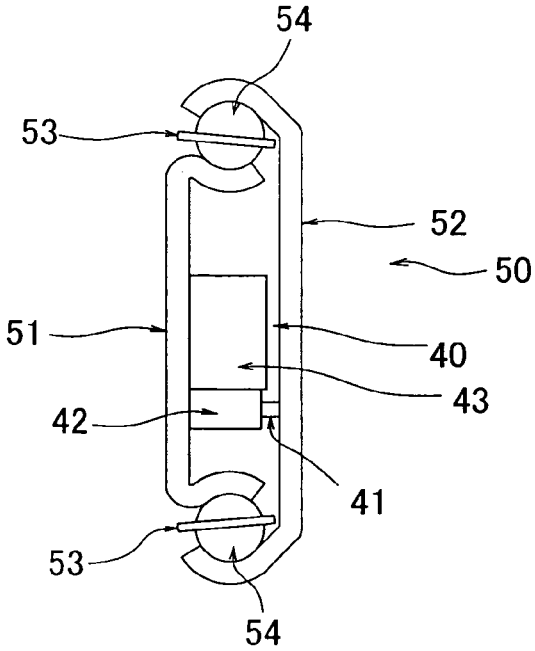

FIG. 17 is a view showing a structure example in which the retracting apparatus having the structure shown in FIG. 10 is provided in the sliding rail so as to be formed as the retracting apparatus of the sliding rail, in which FIG. 17A is a side elevational view of a part thereof, and FIG. 17B is a cross sectional view along a line C—C in FIG. 17A.

As is illustrated, a sliding rail 50 is structured such as to be provided with an inner rail 51 and an outer rail 52. The inner rail 51 may be formed as a fixed rail or may be formed as a moving rail. Further, the outer rail 52 may be formed as the moving rail or may be formed as the fixed rail. In this case, as a matter of convenience for explanation, the outer rail 52 is set to the moving rail, the inner rail 51 is set to the fixed rail.

The outer rail 52 forming the moving rail is supported to the inner rail 51 forming the fixed rail so as to be freely drawn and retracted. In other words, the inner rail 51 having an approximately C-shaped cross section is received such that an opening portion thereof is opposed to an opening portion of the outer rail 52, a lot of balls 54 held by a retainer 53 are interposed between an inner peripheral surface of the outer rail 52 and an outer peripheral surface of the inner rail 51, and the outer rail 52 is supported to the inner rail 51 so as to freely slide in a longitudinal direction (in a drawing and retracting direction).

The guiding member 53 of the retracting apparatus 50 is fixed to the opening portion of the inner rail 51 having the approximately C-shaped cross section and forming the fixed rail, and the driving member 51 of the retracting apparatus 50 is provided in the opening surface of the outer rail 52 having the approximately C-shaped cross section and forming the moving rail so as to protrude to the side of the inner rail 51.

FIG. 17A shows a state in which the outer rail 52 corresponding to the moving rail is drawn in the retracting direction (a direction of an arrow A in FIG. 10). In this state, the sliding member 42 of the retracting apparatus 40 is in a state in which the sliding pin 42*f* is locked to the large-diameter portion 43*c* of the guiding groove 43*a* in the guiding member 43, as shown in FIG. 15A. In this case, although an illustration is omitted, the driving member 41 may be provided in the inner rail 51 and the guiding member 43 may be provided in the outer rail 52.

When pressing the outer rail 52 corresponding to the moving rail in the retracting direction (a direction of an arrow B), the driving member 41 also moves in the retracting direction. When reaching the state in FIG. 15B via the state in FIG. 15A, the sliding member 42 is pressed by the driving member 41, and rotates around the sliding pin 42*f*, and the lock of the sliding member 42 is cancelled at the position shown in FIG. 15C.

Accordingly, sliding member 42 is drawn in the retracting direction by the elastic force of the coil spring 44, and is automatically retracted to the retract end as shown in FIG. 15E, via the state shown in FIG. 15D.

In the case of using the retracting apparatus of the sliding rail having the structure mounted to the sliding rail 50 to which the retracting apparatus 40 mentioned above is mounted, as a retracting apparatus in a drawer apparatus such as a furniture or the like, which is not illustrated, the inner rail 51 corresponding to the fixed rail is mounted to the side of the apparatus main body, the outer rail 52 corresponding to the moving rail is mounted to the side of the drawer portion, and the guiding member 43 is mounted to the side of the apparatus main body. Accordingly, in the case of pushing in the drawer portion to a predetermined automatic retract position from a drawn state, the drawer portion is retracted to the retract end.

Further, in the case of using the retracting apparatus of the sliding rail having the structure mounted to the sliding rail 50 to which the retracting apparatus 40 mentioned above is mounted, for a sliding door apparatus provided with a sliding door mounted to an apparatus main body such as a wall of a building or the like so as to be freely drawn and retracted, which is not illustrated, the inner rail 51 corresponding to the fixed rail is mounted to the fixed side, the outer rail 52 corresponding to the moving rail is mounted to the side of the sliding door, and the guiding member 43 is mounted to the fixed side.

Since the retracting apparatus of the sliding rail is provided in the sliding door apparatus as mentioned above, it is possible to automatically retract the sliding door to the retract end, that is, the close end or the open end, stably, in the case that the sliding door is retracted to the predetermined close or open position, and it is possible to prevent the sliding door from being left in a partly close state and in a partly open state.

In this case, an application of the retracting apparatus in accordance with the present invention is not limited to the apparatus mentioned above in which the fixed body is mounted to the fixed rail of the sliding rail, and the moving body is mounted to the moving rail as mentioned above. The present invention can be widely applied, for example, to a retracting apparatus supported to the fixed body from one moving end position to another moving end position by rollers or the like, in which the moving body moves toward the one moving end position or the another moving end position, and the retracting apparatus is automatically retracted to the one moving end position or the another moving end position in the case that the moving body reaches a predetermined automatic retract position which is a predetermined distance apart from the one moving end position or the another moving end position.

The description is given of the embodiments in accordance with the present invention, however, the present invention is not limited to the embodiments mentioned above, and can be variously modified within a scope of the technical idea described in claim, the specification and the drawings. In this case, every shapes, structures and materials which can achieve the operations and effects of the present invention are considered to be within the technical idea of the present invention, even if the specification and the drawings do not describe the matter directly.

The invention claimed is:

1. A retracting apparatus which is provided with a fixed body and a moving body supported to said fixed body so as to freely move from one end position to another end position, and is automatically retracted to said one end position or said another end position, in the case that said moving body moves toward said one end position or said another end position and reaches an automatic retract position a predetermined distance apart from said one end position or said another end position, comprising:

a driving member mounted to a side of said moving body or a side of the fixed body;

a sliding member engaged with said driving member and sliding;

a guiding member guiding said sliding member; and an energizing member energizing said sliding member to said one side or another side, wherein said guiding member is provided with a guiding groove which guides said sliding member in a predetermined range of said moving body during a period that said moving body moves from said one end position to an automatic retract position or from said another end position to the automatic retract position, and said guiding groove having a large diameter portion formed in an end portion of said guiding groove in a direction of said one moving end position or a direction of the another end position such that a width is larger than a width of said guiding groove, said sliding member is provided with a sliding pin which is inserted through said guiding groove and slides along said guiding groove, the sliding pin of said sliding member slides along said guiding groove in accordance with movement of said moving body in said one end position direction or the another end position direction of the moving body, and rotates in said one end position direction or the another end position direction at said guiding groove end portion, whereby a dimension in an orthogonal direction to said guiding groove is changed, the sliding pin is fitted to said large diameter portion and locks said sliding member, an engagement between said sliding member and said driving member is cancelled, said driving member and said sliding member are engaged with each other at said automatic retract position on the basis of the movement of said moving body in said another end position direction or the one end position direction, and the lock of said sliding member is cancelled.

2. A retracting apparatus as claimed in claim 1, wherein the sliding pin of said sliding member is allowed to rotate in said one end position direction or the another end position direction in the end portion in the side of the one end position or the end portion in the side of the another end position of said guiding groove, and said sliding member is pressed by said driving member so as to rotate around said sliding pin in said one end position direction or the another end position direction by moving said moving body in said one end position direction or the another end position direction, in the case that said sliding member is in the end portion in the side of said one end position or the end portion in the side of the another end position of said guiding groove in a state in which the engagement of said sliding member with said driving member is cancelled, whereby the engagement between said sliding member and said driving member is recovered.

3. A drawer apparatus provided with a drawer portion which is freely drawn and retracted with respect to a cabinet main body, wherein the drawer apparatus is provided with the retracting apparatus as claimed in claim 2, the fixed body of said retracting apparatus is formed as the cabinet main body or is mounted to the side of the cabinet main body, said moving body is formed as the drawer portion or is mounted to the side of the drawer portion, and the guiding member is mounted to the side of said cabinet main body or the side of the drawer portion.

4. A sliding door apparatus comprising:

a cabinet main body; and a sliding door supported to said cabinet main body so as to be freely drawn and retracted, wherein the sliding door apparatus is provided with the retracting apparatus as claimed in claim 2, the fixed body of said retracting apparatus is formed as the cabinet main body or is mounted to the side of said cabinet main body, and said moving body is formed as the sliding door or is mounted to the side of the sliding door.

5. A drawer apparatus provided with a drawer portion which is freely drawn and retracted with respect to a cabinet main body, wherein the drawer apparatus is provided with the retracting apparatus as claimed in claim 1, the fixed body of said retracting apparatus is formed as the cabinet main body or is mounted to the side of the cabinet main body, said moving body is formed as the drawer portion or is mounted to the side of the drawer portion, and the guiding member is mounted to the side of said cabinet main body or the side of the drawer portion.

6. A sliding door apparatus comprising:

a cabinet main body; and a sliding door supported to said cabinet main body so as to be freely drawn and retracted, wherein the sliding door apparatus is provided with the retracting apparatus as claimed in claim 1, the fixed body of said retracting apparatus is formed as the cabinet main body or is mounted to the side of said cabinet main body, and said moving body is formed as the sliding door or is mounted to the side of the sliding door.

* * * * *